United States Patent [19]

Regamey

[11] 4,227,489

[45] Oct. 14, 1980

[54] METHOD AND DEVICE FOR FEEDING A SYSTEM FOR GENERATING AND DISTRIBUTING VAPOR CONDENSABLE INTO MAKE-UP LIQUID

[76] Inventor: Pierre E. Regamey, 35, Le Calabert, 69130 Ecully, France

[21] Appl. No.: 5,372

[22] Filed: Jan. 22, 1979

Related U.S. Application Data

[60] Division of Ser. No. 741,339, , and a continuation-in-part of Ser. No. 741,339, Nov. 12, 1976, Pat. No. 4,177,767.

[30] Foreign Application Priority Data

| | | | |
|---|---|---|---|
| Nov. 13, 1975 | [FR] | France | 75 34705 |
| Sep. 13, 1976 | [FR] | France | 76 27510 |
| Sep. 13, 1976 | [FR] | France | 76 27511 |
| Jan. 23, 1978 | [FR] | France | 78 01773 |

[51] Int. Cl.[3] ..... F22D 1/12

[52] U.S. Cl. ..... 122/457; 122/451 R

[58] Field of Search ..... 122/458, 1 R, 451 R, 122/456, 457; 237/12.1, 13; 60/648

[56] References Cited

U.S. PATENT DOCUMENTS

| | | | |
|---|---|---|---|
| 894,897 | 8/1908 | Osborne | 237/12.1 |
| 977,841 | 12/1910 | Rollins | 122/456 |
| 2,052,855 | 9/1936 | Twomey | 122/458 |
| 2,068,409 | 1/1937 | Hahnle | 122/457 |
| 2,280,574 | 4/1942 | Forse | 122/456 |
| 2,453,211 | 11/1948 | Eaton | 122/456 X |
| 2,870,751 | 1/1959 | Kuljian et al. | 122/451 X |
| 3,116,876 | 1/1964 | Palm | 122/456 |

*Primary Examiner*—Edward G. Favors

*Attorney, Agent, or Firm*—Silverman, Cass & Singer, Ltd.

[57] ABSTRACT

In a system of production, distribution and utilization of condensable vapor with recovery of the condensates in a closed container, a method for forced delivery of condensates consisting in awaiting the obtention of a predetermined level of filling of the container, in isolating from the outside the upper space of the container and in applying at the free surface of the contained liquid a sufficient additional vapor pressure to allow the total available gas pressure to be substantially equivalent to the sum of the necessary net geometrical height of delivery and the down-stream flow pressure losses to be overcome.

39 Claims, 16 Drawing Figures

METHOD AND DEVICE FOR FEEDING A SYSTEM FOR GENERATING AND DISTRIBUTING VAPOR CONDENSABLE INTO MAKE-UP LIQUID

This is a division and continuation in part of patent application No. 741 339 filed on Nov. 12, 1976 now U.S. Pat. No. 4,177,767.

The present invention relates to a method and a device for producing a mechanical impulsion or an acceleration necessary for the delivery of condensates in a system of production, distribution and utilization of condensable vapor.

In a vapor plant where the pressure and the temperature are practically constant everywhere and substantially identically the same at all points (except for the pressure losses), the condensates reach by gravity a general low point, out of which they must be forced under a higher pressure in order to be reintroduced into the vapor generating boiler. This difference in pressure, to be produced between the system of condensate gravity-flow lines (the pressure of which is substantially equal to the pressure in the boiler, less the pressure losses in the vapor phase circuit) and the inlet into the boiler, is equivalent to the total, on the one hand, of the liquid-phase pressure losses between the low point of the systems of condensate gravity-return flow lines and the inlet of the boiler, and, on the other hand, the net geometrical height up to which the condensates must be forced (i.e. the difference between the water levels at the said low point and in the boiler, respectively). The said upper pressure is thus necessary to overcome either the geometrical height of a pitch-retaining pipe rise or the pressure difference (possibly increased by the difference in geometrical height) between two systems at different pressures, in order to force the condensates from the lower-pressure system into the higher-pressure system, out of which the condensates will be forced together with those of the higher-pressure system.

This pressure difference is usually provided mechanically, for example by a rotating device such as a rotary pump or the like. For a great number of technical and economical reasons, it is desirable to avoid the use of a mechanical forcing pump for the reintroduction of the condensates into the vapor generating boiler. Among such reasons, the following should be mentioned:

the desire to reduce financial investments;

the desire to reduce maintenance costs (wear to moving members under severe temperature and pressure conditions);

the elimination of the risk of cavitation of the pump (very rapidly resulting in very strong wear and considerably reducing the hydraulic characteristics) or the elimination of the necessity of required high sucking net positive static head to be produced by tha water level up-stream of the pump, i.e. in the buffer-tank;

the elimination of the requirement of cooling of the rotary shaft bearings and seals;

the almost complete elimination of the risk of stoppage in case of failure or of the necessity to provide for stand-by or emergency devices;

the elimination of the necessity to provide for isolating members, filters or like accessories on the pump in operation as well as on the stand-by pump.

In order to solve this technical problem, the invention provides a method of forced delivery, notably intermittent forced delivery, of condensates either for reintroduction into a vapor generating boiler or for forced-delivery into a system at higher pressure or for the passing of a geometrical rise such as a pitch-retaining pipe rise by a condensate discharge flow in a system of production, distribution and utilization of condensable vapor in a closed circuit where the pressure and temperature are substantially constant everywhere and identically the same at all points except for the pressure losses, with recovery of at least part of the condensates discharged by guided, preferably substantially dry and, at least for the most part thereof, generally gravitational return flow into at least one closed container for at least temporary collection and accumulation forming a main buffer-tank or the like located at a local or general low point. This method is characterized in that it consists, in a manner known per se, in awaiting the obtention of a predetermined maximum level of filling of the said buffer-tank with liquid; in isolating, from outside, the upper space of the said buffer-tank containing the gaseous phase by cutting off all at least unidirectional fluid communication with at least the up-stream portion of the said system or in stopping the up-stream admission and in preventing any return of the down-stream current of the condensates into the said buffer-tank; and in applying, at the free surface of the contained liquid, a sufficient additional vapor pressure to allow the total available gas pressure to be substantially equivalent to the sum of the necessary net geometrical delivery height and of the downstream flow pressure losses to be overcome.

According to another feature of this method, there is provided a control cyclical operation with periodical repetition with automatic control in interlocked follow-up relationship to the present amount of condensates present in the said container forming the said buffer-tank in a manner known per se.

Within the scope of and in correlation with the subject matter referred to hereinabove the present invention relates also to a process of feeding a system for generating and distributing vapor condensable into make-up liquid; it is also directed to plants for carrying out and involving application of the said process.

Usually, in a system for producing and distributing condensable vapor, the boiler, or each boiler, can be re-fed by means of a collecting tank for the condensates resulting from the use of the said vapor and of a pump for direct readmission of the said condensates into the boiler or each boiler from the said collecting tank.

Moreover, the said direct readmission of the condensates into the boiler is advantageously interrelated with the liquid level therein as disclosed in the parent patent application. In this connection, use can advantageously be made, in the condensates return and collecting circuit, of a certain number of devices such as for example flow lock means, a vapor pump, a thermodynamic pump, and admission lock means.

The flow lock means is a device allowing, for example, the readmission of condensates from a first circuit into a second circuit where the pressures are not identical.

The vapor pump is a device for applying to the free surface of a liquid contained in a container a sufficient vapor pressure to force the liquid into another circuit.

The thermodynamic pump uses the same principle as the vapor pump, but the necessary forcing vapor pressure is obtained in a different manner from that of the vapor pump, as will be seen later.

The admission lock means allow the condensates from a lower-pressure circuit to be periodically admitted for example into a higher-pressure vessel. The operating principle of this lock means is different from that of the flow lock means, as will appear later.

In the first three above mentioned devices, the forced delivery of the condensates contained in a container is obtained by applying to the liquid surface in the said container a vapor pressure $P_1$ higher than the pressure $P_2$ prevailing in the line or the vessel into which the liquid from the said container is forced, which vapor pressure may be either permanent (flow lock means) or intermittent (vapor pump and thermodynamic pump); in the case of the vapor pump, the vapor pressure $P_1$ is obtained by conveying live vapor, preferably from the vapor system issuing from the boiler, onto the aforesaid liquid surface, whereas in the case of a thermodynamic pump the vapor pressure $P_1$ is obtained by heating the liquid in the container containing the condensates to be forced towards the said line or vessel, for example to the condensate collecting tank.

The fourth above mentioned device, referred to as the admission lock means, is based on another principle: the container from which the condensate is forced out is necessarily located at a higher geographical level than that of the line or of the vessel into which the condensate is to be forced, the pressure in the said container being momentarily brought to the value of the pressure P in the said line or the said vessel just long enough for the said container to be emptied of the condensates, by admitting vapor under pressure P into the said container.

A further object of the present invention is to allow such devices to be systematically used in plants for producing vapor and returning the condensates to the boiler.

Another object of the present invention is to allow the smallest possible number of power or mechanical pumps in such plants and even any pumps to be done away with.

Still another object of the present invention is to allow a high-output pump to be used for delivering water from the condensate collecting tank to the boiler when it is deemed appropriate to use the pump for that purpose.

At last, another object of the present invention is to simplify the control of the liquid level in the vapor generating boiler.

The four above-described devices, namely, the flow lock means, the vapor pump, the thermodynamic pump and the admission lock means, are used in vapor generating, distributing and utilizing or consuming plants of the closed-loop type without separation of the vapor from the condensates down to a low point where the latter gather in such a manner that, in such plants, the pressure and temperature of the vapor are practically constant, except for the pressure losses, in each of the systems, namely, in the case considered, the vapor generating and distributing system and the condensate return system, owing to the vapor and the condensates being in permanent and intimate contact.

Through the various aforesaid devices, each placed at a low point of a system, the condensates alone are forced into the condensate collecting tank in order to be directly readmitted into the vapor generating boiler. The temperature of the condensates in each of the said devices is therefore closely dependent upon the vapor pressure in the condensate return system, and therefore upon its condensation temperature. The final temperature of the condensates gathered in the collecting tank is therefore the resultant of the temperatures of condensates from various sources.

The condensate collecting tank being closed, its upper portion located above the liquid level therefore contains vapor of self-vaporization in equilibrium with the condensates at the corresponding temperature on the saturation vapor tension curve.

In order to avoid any risk of cavitation at the intake of the pump for direct readmission of the condensates into the vapor-generating boiler from the aforesaid collecting tank, one of the following two precautionary measures is taken in the present state of the art:

(1) either a cooling of the condensates located below the liquid level is brought about so that their temperature is lower than the one corresponding to the then prevailing pressure. By this means the NPSH available for the pump is improved. It will be recalled here that with NPSH is meant the magnitude known as "net positive succion head";

(2) or the liquid level in the collecting tank is placed at a sufficiently high geographical level with respect to the pump for direct readmission of the condensates into the boiler, taking into account the NPSH required by the latter and the loss of pressure between the said liquid level and the pump, at the rate of flow considered; under such conditions, the pressure head may be such that the available NPSH thus obtained exceeds at any instant the NPSH required by the assembly constituted by the said pump and the line which is comprised between the condensate collecting tank and that pump.

In both the above cases, use was made, in order to avoid placing the liquid level in the condensate collecting tank at too high a geographical level, of readmission pumps of the low NPSH (i.e. the above-mentioned "required NPSH") type. Such pumps are essentially of the so-called "lateral passage" type based on the principle of semi-volumetric operation. Such pumps are complex in design, very easily damageable, have very small working allowances and are highly expensive. Moreover, they impose very specific and very strict limitations on flow rates, pressures and lay-out. At last, their maximum output is limited to values that are incompatible with large-size plants.

In addition, in the known state of the prior art, two concurrent controls of the liquid level in the boiler must be performed, namely, a control of the direct readmission of the condensates from the condensate collecting tank and a control of the direct admission of make-up water from a feed-tank into the boiler, thus complicating the control of the said liquid level and possibly resulting in disturbances in the said control.

All the above considerations have led to an installation of the aforesaid type but of a novel design, including a direct readmission of condensates into the boiler. The process according to the present invention is of the type wherein provision is made for direct readmission of condensates from a condensate collecting tank into the vapor generating boiler and wherein a vaporizable make-up liquid is supplied to a condensable vapor generating, distributing and utilizing system, for the purpose of vapor production by the said boiler, and is characterized in that the entire quantity of vaporizable make-up liquid is directed to the collecting tank which ensures the whole of the feeding of the boiler with the said vaporizable liquid.

Any disturbance in the control of the liquid level in the boiler is thus avoided since the need for two concurrent controls is eliminated. Indeed, the supply of vaporizable make-up liquid in the plant takes place exclusively at the collecting tank, in case of want of condensates in the latter, i.e. when the quantity of liquid in the collecting tank tends to become too small. In the present specification, the term "quantity of liquid" is used in its broad sense and applies to a mass as well as a volume or a level, and the said quantity may be either fixed, possibly zero, or variable.

Thus, according to a characterizing feature of the present invention, the inflow of vaporizable liquid into the boiler may be controlled automatically and in such a manner that the water level in the boiler influences only the direct readmission of the said liquid from the collecting tank.

According to another characterizing feature of the present invention, the inflow of vaporizable liquid into the boiler from the aforesaid collecting tank is controlled automatically in dependence of, exclusively, the water level in the boiler.

An another advantage of the present invention consists in that, if use is made of a pump, called a feed pump, to supply make-up water to the condensate collecting tank, it is sufficient for such feed-pump to be run intermittently, such runnings being limited to the periods of time resulting from the regulation of the quantity of liquid in the collecting tank. Consequently, in plants where the make-up liquid constitutes only a small portion of the liquid to be admitted to the boiler, electric-power consumption is considerably reduced.

According to one form of embodiment of the present invention, vapor at maximum pressure is continuously drawn from the vapor distributing circuit, and such vapor, possibly after reducing its pressure in a pressure-loss device, is supplied to the aforesaid collecting tank so as to constantly maintain therein a higher pressure than the pressure corresponding to the temperature of the condensates on the vapor tension curve (pressure of self-vaporization).

This form of embodiment offers the possibility, by using the pump for direct readmission of the condensates from the said collecting tank into the boiler, of avoiding the need for placing the said collecting tank in such a manner that the liquid level therein be permanently at a higher geographical level than that required by the NPSH of the pump.

It is also possible, according to the present invention, to apply a vapor pressure to each liquid surface in the various containers or vessels feeding the tank for collecting all the condensates, the said vapor pressure, which may be either permanent or intermittent, being equal to the pressure in the boiler, except for the pressure losses in the line.

It is therefore possible, irrespective of the various working pressures, temperatures, geographical levels, distances, working hours, rates of flow, controls, and so forth, for all the condensates in the plant to be gathered in a single collecting tank in which the pressure may be very close to that in the vapor generating boiler. The actual temperature of the condensates in the single collecting tank is the resultant of the mixture of condensates from the various sources. Only the liquid surface layer of a few millimeters in thickness is at a higher temperature as a result of a partial condensation of the vapor at high pressure being in contact therewith. The final mean temperature of the mass of condensates in the single collecting tank is markedly lower than the one corresponding to the then pressure on the saturation vapor tension curve. The NPSH available for the pump for direct readmission of the condensates into the boiler from the said collecting tank is therefore equal to the sum, of the geographical height (positive or negative) of the liquid level in the tank with respect to the pump succion, and the height of the imaginary water column representing the difference between the real pressure in the collecting tank and the pressure corresponding to the temperature of the condensates on the saturation vapor tension curve.

This second factor is then so preponderant over the first one that it allows all restraints resulting from the low NPSH requirement to be avoided and therefore permits not only the use of any type of readmission pump merely compatible with the pressure and the temperature but also the installation of the condensate collecting tank and the said readmission pump without any restraint regarding the geographical level.

In addition, the pressure prevailing in the condensate collecting tank being very close to the pressure in the boiler, the said pump for direct readmission of the condensates will only have to ensure a hydraulic or delivery head equal to the afore-mentioned difference plus the loss of pressure between the pump and the boiler.

Moreover, the small pressure difference between the condensate collecting tank and the vapor generating boiler being constant, the readmission pump permanently operates within the same region of its characteristic curve, thus allowing the design characteristics of the said pump to be so selected as to ensure its maximum efficiency.

Consequently, this novel conception of the feeding of boilers with vaporizable liquid permits:

the use of pumps of ordinary design irrespective of any required NPSH, therefore of pumps which are more sturdy and less expensive;

the reduction to a considerable extent of the necessary hydraulic or delivery head, therefore the use of a lower-power pump and driving motor therefor and an important and corresponding saving of electric power;

a more stable operation since the operation of the pump is permanently within a same region of its characteristic curve.

According to another form of embodiment of the present invention, the inflow of vaporizable liquid into the boiler takes place without requiring any pump, by means of a collecting tank placed above the vaporizable liquid level of the said boiler, by directing to the said collecting tank, during a stage of filling of the latter, the condensates at the pressure in the condensate return system, and by causing the said collecting tank, forming a distributing lock means, to communicate with the vapor distributing system, during a stage of emptying of the said collecting tank and of return of the condensates to the boiler.

Advantageously, use is made of two such collecting tanks mounted in parallel, in a similar manner, in the downstream portion of the condensate return system, the said two tanks being connected in a similar manner to intakes of vapor at the pressure of the vapor distributing system, the said two tanks forming two admission lock means working in opposition, one of them being in the emptying stage while the other is in the filling stage, and vice versa.

As mentioned above, this form of embodiment allows any pump for readmission of the condensates into the boiler to be dispensed with.

According to still another form of embodiment of the invention, the need can be avoided of using a feed pump, even one operating intermittently, to supply vaporizable make-up liquid from a feed tank to the condensate collecting tank or tanks directly feeding the boiler with vaporizable liquid. Thus, by combining this last form of embodiment with the second aforementioned form of embodiment, the whole plant can be operated without using a power or mechanical pump.

According to this last form of embodiment, the admission of make-up water into the aforesaid collecting tank or tanks is by means of an auxiliary tank placed above the vaporizable liquid level of the said condensate collecting tank, the said auxiliary tank being fed, during the stage of filling of the said auxiliary tank, with make-up liquid at a lower pressure than the pressure in the condensate return system, the make-up fluid contained in the said auxiliary tank being thereafter directed to the said collecting tank, during a stage of emptying of the said auxiliary tank, by causing the said auxiliary tank, forming an admission lock means, to communicate with the condensate return system.

The inflow of vaporizable liquid into the said auxiliary tank is advantageously controlled automatically and in dependence only of the quantity of liquid in the said auxiliary tank, irrespective of the quantity of liquid in the boiler.

The invention will be better understood and other purposes, features, details and advantages of the latter will appear more clearly as the following explanatory description proceeds with reference to the appended diagrammatic drawings given solely as non-limitative examples illustrating the various presently preferred specific forms of embodiment of the invention and wherein.

Figure 15:
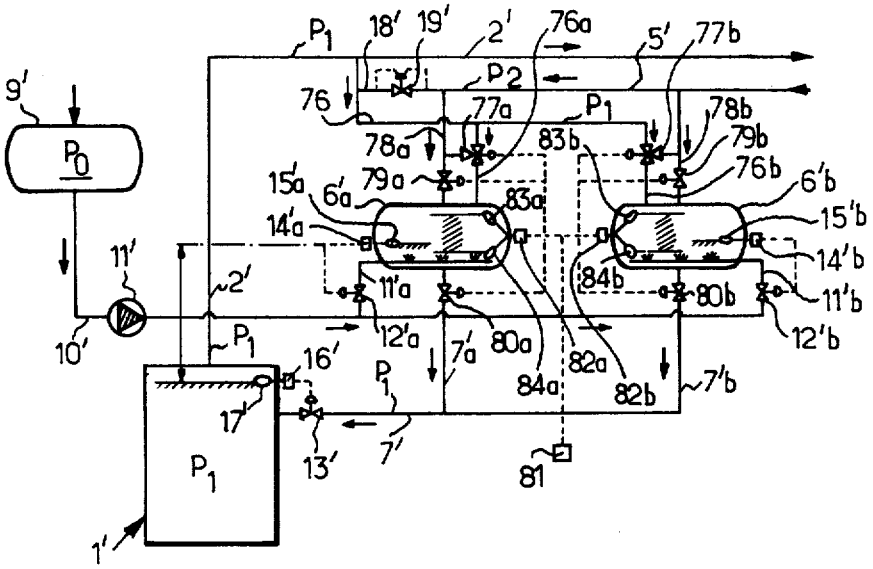
Figure 16:
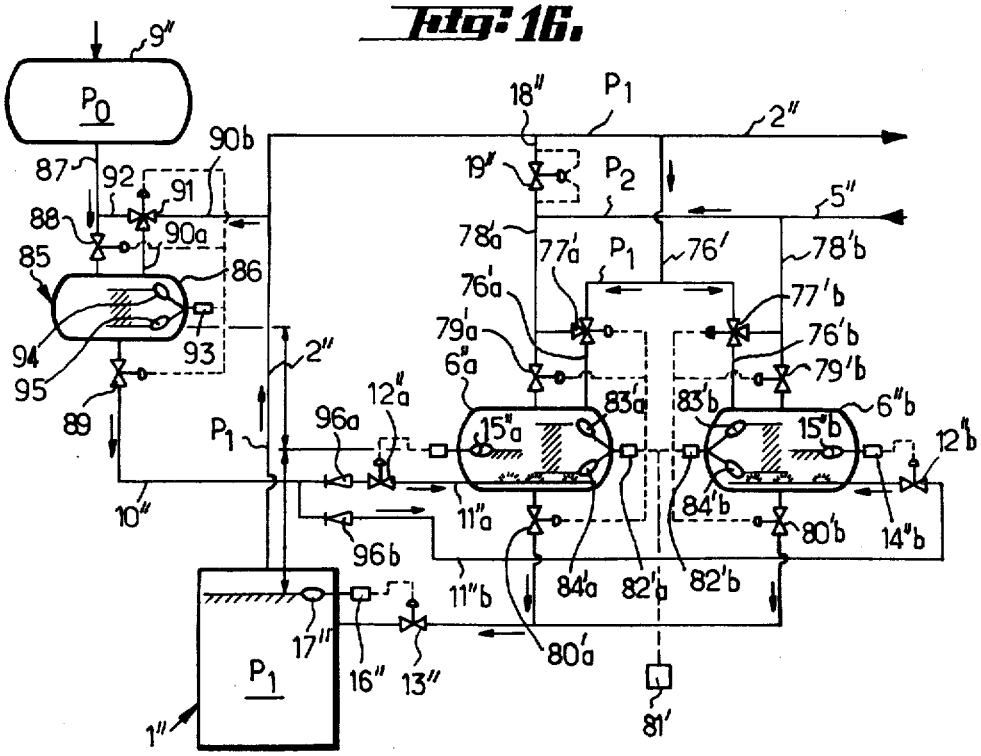

FIG. 15 is a diagrammatic view of a similar plant employing only one pump for the admission of vaporizable make-up liquid and using two condensate collecting tanks both of which are located at a higher level than that of the boiler; and FIG. 16 is a diagrammatic view of a plant similar to that of FIG. 15, but in which no pump is used for the admission of vaporizable make-up liquid into the two condensate collecting tanks, the said admission being by means of an auxiliary tank operating as an admission lock means.

The device according to FIGS. 1 to 13, for the carrying out of the aforesaid method, comprises at least one main buffer-tank, 14, 105 provided with at least one maximum and minimum level controller 53, 107 and intercalated in an inclined descending condensate-return conduit 15, 125 opening into the said boiler, the said main buffer-tank being placed either at a general low point to form a pumping sub-station for reintroducing into the boiler, or at a local low point or a pitch-retaining pipe rise, to form a lift-pumping sub-station for geometrical rise passing, the up-stream portion 15 or 101' and downstream portion 16 and 116' of this conduit being connected to the upper and lower portions, respectively, of the main buffer-tank 14, whereas a check valve or the like 20, 20' is intercalated in the said downstream conduit portion 16 or 106'. This device is characterized by means for additional introduction or local production of vapor in the upper space of the main buffer-tank 14, the said means comprising a piloting or switching member connected by a remote-control transmission 54, 54'', 124 to the monitoring member of the aforesaid level controller 53, 107, whereas, in a manner known per se, a check valve 20' is mounted in series in the said up-stream conduit portion 15, 101, 101'.

According to one form of embodiment, the said method consists in heating at least part of the liquid phase, present in the said container forming the buffer-tank, through external heat supply in order to raise its temperature and vaporize part of the said liquid in order to increase the pressure and thus create a thermodynamic pumping effect producing the circulating impulsion. This theoretical principle is understood by considering a closed container such as a buffer-tank 14 in FIG. 1 filled with condensates (liquid water in the case considered) at any temperature and the uncondensable products of which have been previously discharged. The upper portion of this container, not occupied by the liquid phase, contains the vapor which is at a pressure corresponding to the temperature of the liquid on the saturation vapor tension curve for the vapor of the fluid considered (which in this case is water). If this liquid water is heated by any means 140 while the container 14 is kept always closed, to each new temperature strictly corresponds a new pressure which is always situated on the saturation vapor tension curve. It is therefore sufficient to heat the condensates, contained in the buffer-tank 14 placed at the general low point of the system of condensate gravity-return lines or at the local low point of the condensate return pipe rise, in order to increase their pressure concomittantly with the increase of their temperature. Starting from a certain pressure increase value, it is thus possible to directly reintroduce the condensates into the vapor boiler or to make tham pass the pipe rise. Thus, the desired efficient or useful pressure increase is obtained simply by heating the contained condensates from the initial temperature to the final temperature to cause them to pass from an initial pressure to a final pressure. At the beginning of this heating cycle, the volume located below the condensates is filled with saturated vapor at a pressure corresponding to the temperature defined on the saturation vapor tension curve. The increase of the temperature also results in a vaporization, the importance of which is determined by the difference between the total heats or enthalpies contained in the initial and final masses, respectively, of the vapor confined in the container 14. Thereafter, a constant and complex mutual heat exchange takes place in both directions between the mutually contacting vapor and condensates. As a matter of fact, the actual heating power to be furnished for such a thermodynamic pump is simply that which is necessary to raise the temperature of the liquid phase or water of the working fluid from the initial temperature to the final temperature. Thus, when the upper condensate-level $N_3$ is reached in the tank of the thermodynamic pump, the space comprised between this upper level $N_3$ and the top $N_4$ of the tank contains saturated vapor under the same pressure and at the same temperature as the condensates, therefore at the pressure called initital pressure. In order that these condensates may thereafter be delivered by means of the thermodynamic pump, it is necessary that, at the end of the delivery cycle, the initial volume of condensates be replaced by saturated vapor at the pressure called final pressure. In order that the condensates may be delivered it is therefore necessary to furnish a heating power which is sufficient on the one hand, to raise the temperature of the condensates from the initial value to the final value, therefore to furnish sensible heat; and on the other hand, to vaporize the necessary weight of water to allow the vapor thus produced to occupy at the final pressure, the volume of the vaporized condensates and the portion of the volume of initial vapor given up by the latter with the increase of its pressure, therefore the increase of its density. This vaporization necessitates the supply of vaporizing heat.

From the total of the two foregoing items, it is necessary to deduce the difference between the latent vaporizing heats at the initial and final pressures, respectively, of the initially present weight of vapor. It is found that the greater part of the heating power to be furnished serves to raise the temperature of the liquid water and, since this power is furnished to the fluid (water) itself, it is integrally contained in the condensates at their inlet into the boiler and is totally recovered on the latter, so that it is to be deduced from the power to be furnished by the boiler, therefore from the heating fuel consumption in the furnace of the latter. If the heating power thus furnished to the condensates is for example of electrical origin, its unit-price in the thermodynamic pump will be substantially higher than that of the power furnished to a boiler whose furnace is fed with relatively less expensive fuel. On the other hand, this power consumption in the thermodynamic pump is relatively higher than the power consumption in a mechanical pump offering the same characteristics. It results therefrom that the thermodynamic pumping device according to the invention is justified essentially in cases of small over-pressures and small flow-rates which are difficult characteristics to obtain by means of the conventional pumps, as well as in the case where the net positive sucking head required by a conventional pump is prohibitively high.

According to the forms of embodiment illustrated in FIGS. 1 to 11, the aforesaid heating means are constituted by at least one heating resistor 140 or an equivalent heat supply means in transmission and heat-exchange connection with at least part of the lower volume of condensates contained in the main buffer-tank 14 or 105. The switching on or off of this heating resistor is controlled by means of the remote-control transmission 54 or 124 by the level controller 53 or 107. In FIGS. 1, 2 and 8 to 11, when the float of the level controller 53 or 107 reaches the upper level $N_3$ during the rise of the condensates in the buffer-tank 14 or 105, the level controller ensures through the remote-control transmission 54 or 124 the switching on of the heating resistor 140 which then heats the condensates to increase their pressure from the value $P_1$ (which is substantially the pressure within the boiler) to the value $P_2$ necessary to force up the condensates for their direct reintroduction into the boiler. During this forced delivery, the level of the condensates lowers in the buffer-tank and, when they reach a lower level $N_1$, the level controller 53 automatically ensures the switching off of the heating resistor 140.

According to another general feature of the aforesaid method, illustrated in FIGS. 2 to 4 and 8, 9 and 12, provisions are made for a temporary collection and accumulation of the condensates in at least one auxiliary buffer-tank 105' up-stream of the main buffer-tank 14 during the forced delivery of the condensates from the latter by way of pumping. According to another general feature of the aforesaid method, illustrated in FIGS. 2 to 4 and 9 to 12, means are provided for preferably automatic vapor-pressure release, known per se, from the main buffer-tank 14 or 105 at the end of the forced delivery cycle, and this release is continued until the said vapor pressure in the said buffer-tank again becomes substantially equal to the pressure of the condensates up-stream of the said main buffer-tank. According to still another feature of the aforesaid method, the equalization of the aforesaid pressures is obtained by providing a direct temporary and controlled communication between the respective upper gaseous-phase confinement spaces of the said main and auxiliary buffer-tanks, respectively, or between the upper space of the said main buffer-tank and either the up-stream admission flow of condensates or preferably the up-stream supply flow of live vapor in case of afore-mentioned pitch-retaining arrangement as illustrated in FIGS. 2 to 4 and 9 to 12.

Figure 1:
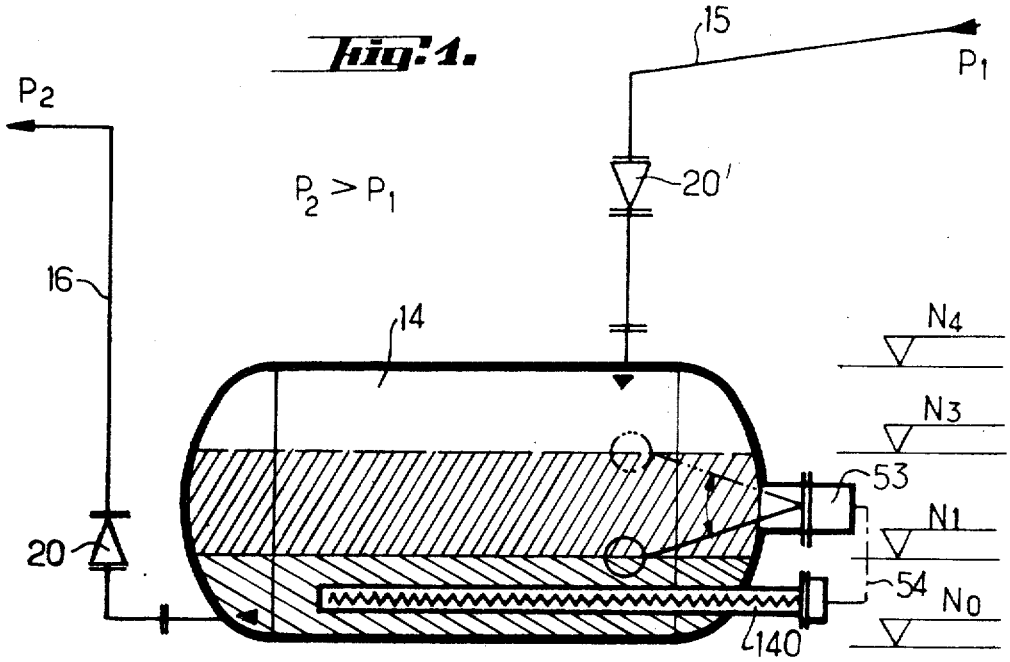
FIG. 1 is an isolated, longitudinal sectional view of a main condensate-collecting buffer-tank equipped with a means for internal heating of the condensates and illustrating the principle of a thermodynamic pumping sub-station.
Figure 2:
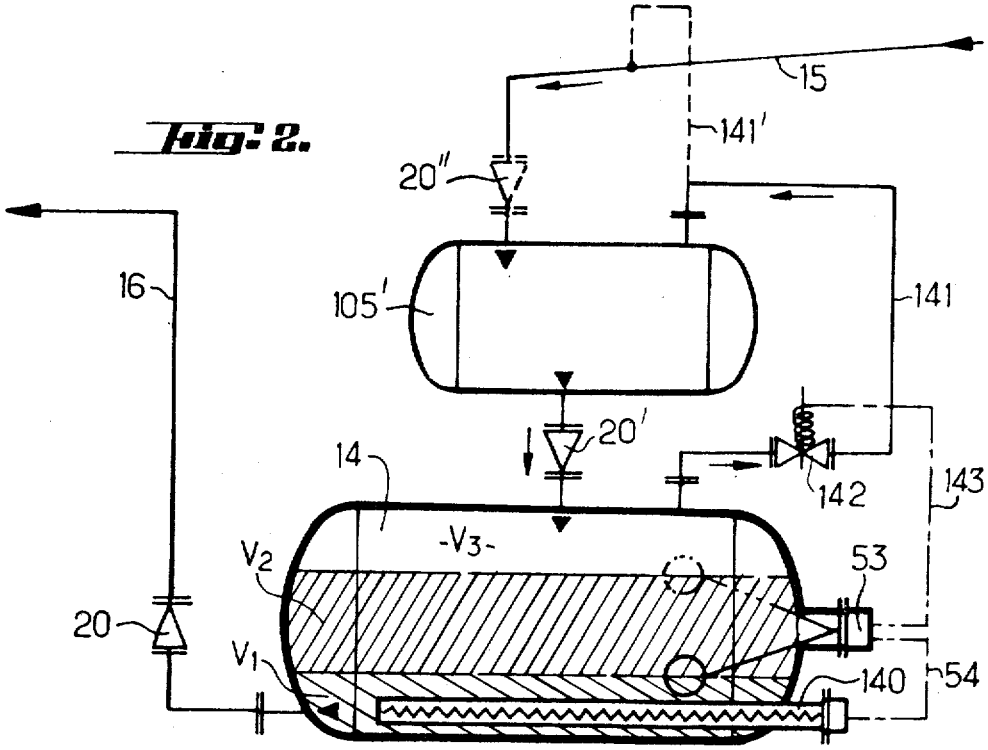
FIG. 2 is a view similar to FIG. 1, but where the thermodynamic pumping sub-station is preceded by an auxiliary buffer-tank for temporary accumulation of the condensates, with pressure discharge from the main buffer-tank into the auxiliary buffer-tank.

An arrangement for applying the aforesaid characteristic features of the method is illustrated in FIG. 2, wherein at least one auxiliary buffer-tank 105' is intercalated in series in the up-stream portion 15 of the condensate return conduit before the afore-mentioned check valve 20' of the latter and possibly after an additional up-stream check valve 20''. The upper portion of the main buffer-tank 14 is connected by at least one vapor discharge conduit 141 either to the upper portion of the auxiliary buffer-tank 105' into which it opens, or (as shown by a dotted line 141') to the up-stream portion 15 of the condensate return conduit, preferably before the check valve 20'', through the medium of a preferably motor-actuated stop valve 142 whose servo-motor is connected through a remote control transmission 143 to the monitoring member of the level controller 53. The capacity of the auxiliary buffer-tank 105' is preferably substantially equal to the condensate volume $V_2$ defined between the uppermost and lowermost positions corresponding to the maximum level $N_3$ and the minimum level $N_1$, respectively, of the float or the sensing member of the level controller 53 in the main buffer-tank 14 which respectively switch on and switch off the heating means constituted by the resistor 140.

The operation of the device of FIG. 2 is as follows: assuming the main buffer-tank 14 to be initially substantially empty or to contain only a minimum condensate volume $V_1$ sufficient to bathe or submerge the heating means 140, the detecting means, for example the float means, of the level controller 53 is in its lowermost position (indicated by a plane line in FIG. 2) corresponding to the minimum level $N_1$ so that the heating means 140 is not switched on and the valve 142 is open, thus providing a communication between the upper, vapor-phase space (capacity $V_3$) of the main buffer-tank 14 and the upper space of the auxiliary buffer-tank 105' for the momentary storage of the condensates, thus resulting in an equalization of the respective pressures in these two tanks, causing the pressure in the main buffer-tank 14 to become equal to the pressure in the condensate gravity-flow system, thus leading to the opening of the non-return valve 20'. Consequently, the condensates temporarily accumulated and retained in the auxiliary buffer-tank 105' can freely flow by gravity through the check valve 20' to enter the main buffer-tank 14 and fill the same up to a predetermined level $N_3$. When the detecting member of the level controller 53 is thus raised to its uppermost position corresponding to the maximum level shown in FIG. 2, the level controller 53 automatically ensures the closing of the valve 142 and the operation of the heating means 140 until the necessary delivery pressure $P_2$ causing an at least partial emptying of the main buffer-tank 14 is obtained, after which the aforedescribed cycle is thus repeated periodically and indefinitely.

Figure 3:
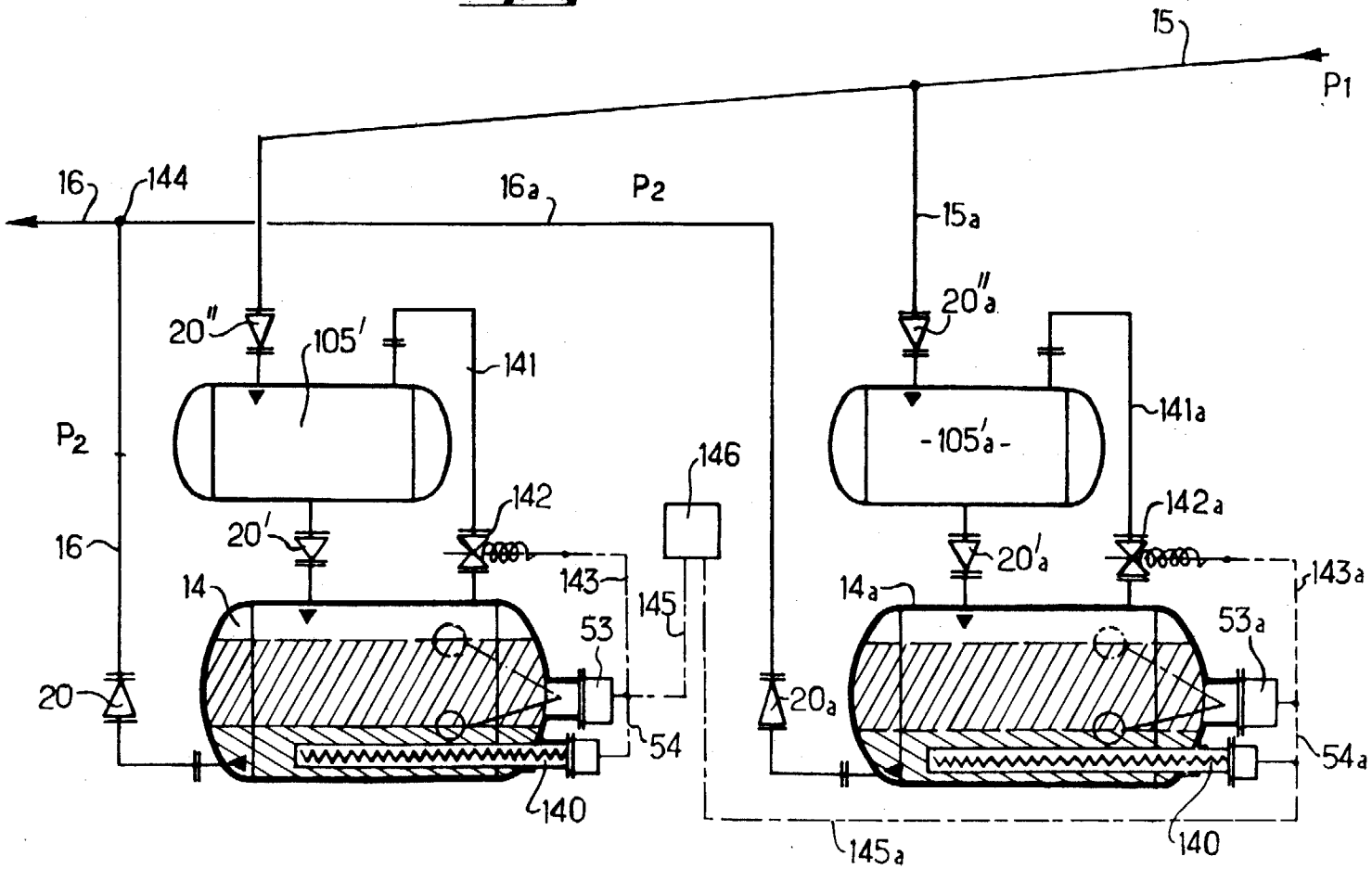
FIG. 3 shows two systems, respectively similar to that of FIG. 2 and mounted in parallel in one and the same condensate return network.

FIG. 3 illustrates the application of the aforesaid method to at least two pumping sub-stations mounted in parallel, the said method being characterized, in this case, by an automatic time-lag or delay interlocked in follow-up relationship with the present amounts of condensates contained in the individual main buffer-tanks of the said pumping substations in order to throw their respective operations out of step with respect to one another for the purpose of a possibly substantially continuous replenishment of the said boiler with liquid to be vaporized through separate operation of a sub-station during the filling of the other with condensates. FIG. 3 shows an arrangement for the carrying out of this method in a system where each said pumping sub-station is identical with the one shown in FIG. 2, the elements of the second sub-station being designated by the same reference numerals as those of the first one accompanied by the index a. The condensate delivery pipings 16, **16*a* unite at a point of confluence 144 into a common single piping for the reintroduction of the condensates into the boiler, whereas the condensate gravity-return conduit 15 leading to the auxiliary buffer-tank 105' of one of the pumping sub-stations feeds the auxiliary buffer-tank 105'*a* of the other pumping station through a branch conduit 15*a*. This arrangement is characterized in that the monitoring member of the level controller 53, 53*a* of each main buffer-tank 14, 14*a* is connected by an individual remote-control transmission 145, 145*a*** to a member forming a time-lag regulator relay which allows continuous direct reintroduction of the condensates into the boiler to be obtained owing to both the thermodynamic pumping sub-stations operating alternately to deliver the condensates, one of the stations delivering the condensates by emptying its main buffer-tank while the main-buffer tank of the other is filling, and vice versa.

Figure 4:
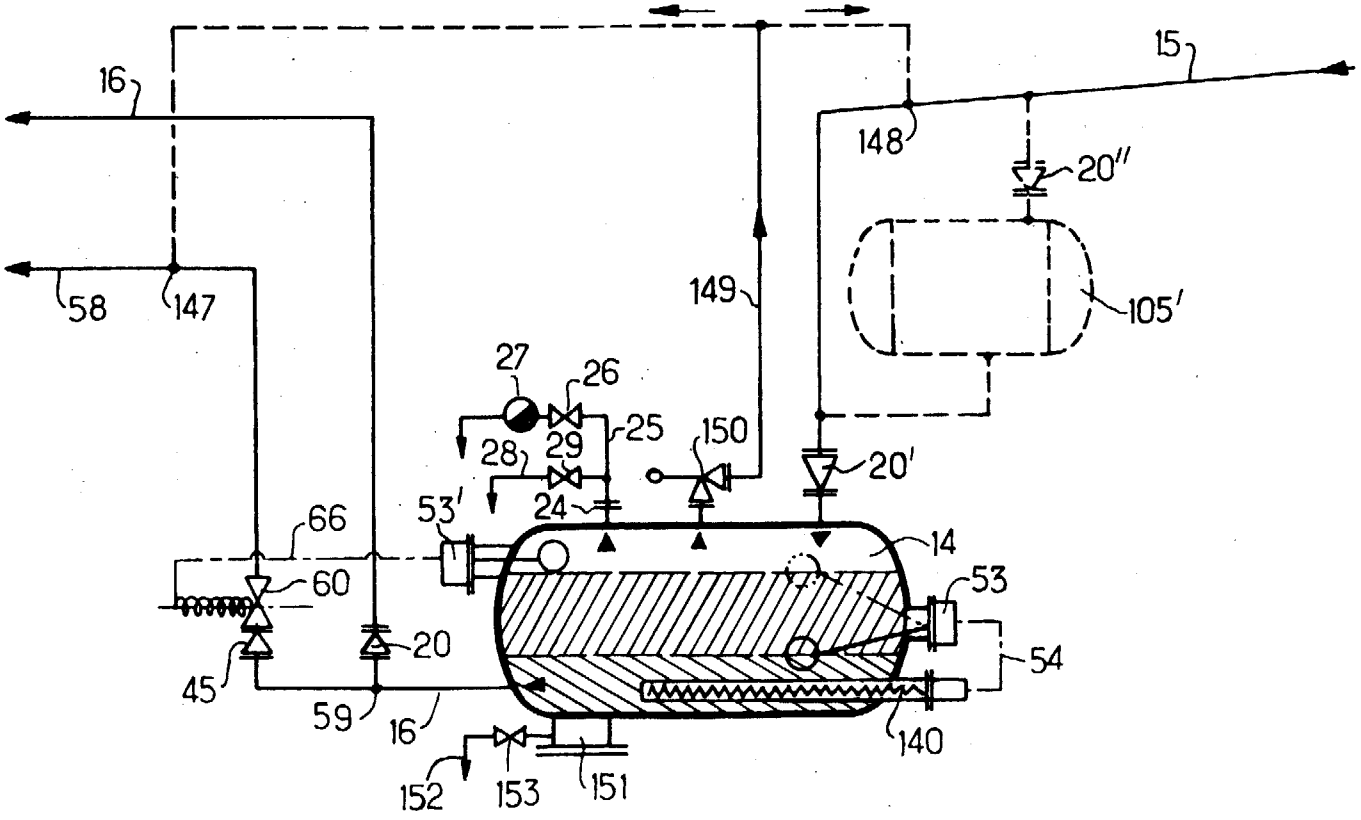
FIG. 4 is a view similar to FIG. 2, but to a smaller scale, showing the aforesaid main buffer-tank provided with excess condensate discharge means and over-pressure discharge means.

FIG. 4 illustrates an additional modification of the method of the invention, according to which a safety discharge may be provided to discharge the excess condensates which are present in the main buffer-tank 14, notably into a feed-tank or into a lower-pressure (not shown), the said safety discharge being preferably interlocked in follow-up relationship through automatic control with the admissible maximum liquid level in the main buffer-tank, in particular in case of absence of needs or of reduced needs of the vapor boiler in liquid to be vaporized. This variant is characterized by a safety discharge of vapor in case of over-pressure in the main buffer-tank (due to the temperature rise in the latter in the absence of discharge of the condensates), this discharge being interlocked in follow-up relationship through automatic control with the maximum admissible pressure and taking place either into the excess condensate discharge line or into the up-stream admission flow of condensates.

In the arrangement illustrated in FIG. 4 and intended for the carrying out of this method, at least one or each main buffer-tank 14 of the system may be provided with an upper level controller 53' and has its lower portion connected to a feed-tank or to an aforesaid lower-pressure system by at least one condensate discharge conduit 58 advantageously containing a check valve 45 and a motor-actuated stop valve 60 whose servo-motor is connected through a remote-control transmission 66 to the monitoring element of the said upper-level controller 53'. This condensate discharge conduit 58 is connected at a confluence point 59 to the condensate delivery piping 16. This arrangement is characterized in that the upper portion of the main buffer-tank 14 is connected to the condensate discharge conduit 58 (at a point 147 located down-stream of the valve 60) or to the up-stream portion of the condensate return conduit 15 (at a point of connection 148 located up-stream of the check valve 20') by a safety relief conduit 149 containing a safety valve or the like 150; these two possibilities of connection of the conduit 149 are indicated by dotted lines in FIG. 4. The condensate gravity-return conduit 15 may lead to the main buffer-tank 14 either directly as indicated by a full line in FIG. 4 or indirectly through an auxiliary buffer-tank 105' preceded by a non-return valve 20'' as indicated by dotted lines in the same Figure. The main buffer-tank 14 may also be provided with a bleeding conduit 25 for the non-condensable substances, containing an automatic bleeder 27 preceded by a stop-valve 26, a bleeding conduit 28 provided with a manual drain-cock 29 being connected in parallel to the conduit 25 in a manner known per se. The main buffer-tank 14 is also provided in its bottom with a decantation pot 151 provided with an emptying outlet 142 equipped with a stop-valve 153.

The operation of the arrangement just described is as follows: when the main buffer-tank 14 has been filled with condensates up to the predetermined level starting the operation of the level controller 53, the latter sets the heating means 140 to work, thus causing the condensates to be delivered or forced out from the main buffer-tank 14 through the piping 16 as a result of a thermodynamic effect. If the needs of the boiler or of the higher-pressure system re-fed with the thus delivered condensates are smaller than the flow rate of delivery of condensates as a result of the said thermodynamic effect, the condensates in the main buffer-tank 14 may possibly continue to rise up to a level which causes the upper level controller 53' to operate and bring about the opening of the valve 60 (generally closed during normal operation), thus allowing the excess condensates to be discharged through the discharge conduit 58 and all the possible vapor over-pressure in the upper space of the buffer-tank 14 to be discharged through the safety valve 150 and the discharge conduit 149.

Figure 5:
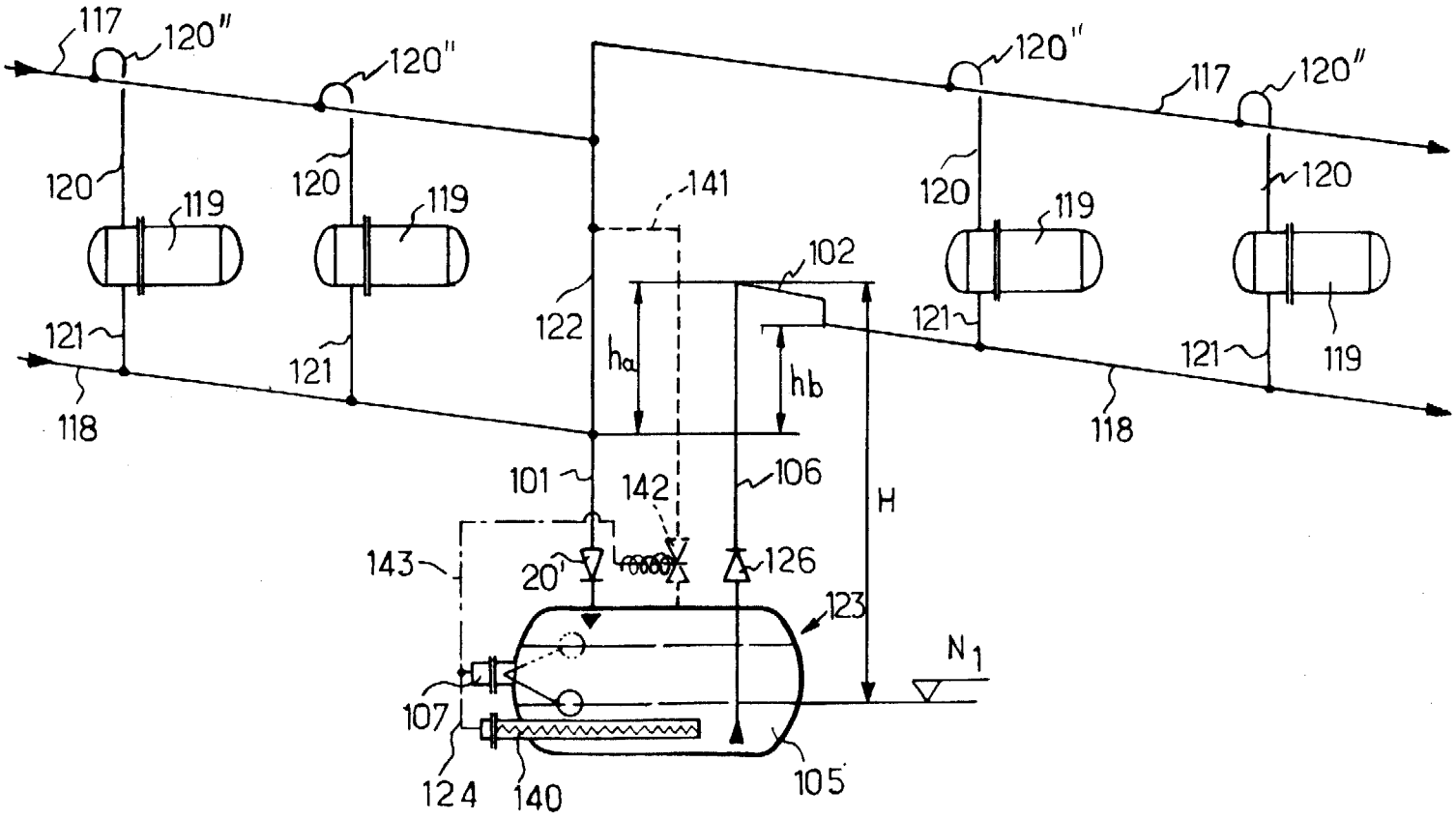
FIG. 5 is a fragmentary view of a two-pipe network of condensable vapor utilizer apparatuses, including a common condensate return conduit with a pitch-retaining pipe rise provided with a thermodynamic pump.

FIG. 5 illustrates the application of the foregoing principles to a two-pipe system including at least two distinct line systems for, respectively, the admission of live vapor (117) and the discharge of condensates (118), between which are connected, in parallel or in derivation, vapor user or utilizer apparatus or vapor consumer stations such as for example heat exchangers 119 each of which is connected to a common main vapor-admission conduit 117 and to a common main inclined descending condensate-return conduit 118 through a vapor inlet pipe 120 and a condensate outlet pipe 121, respectively, the inclined condensate-return conduit 118 being provided with at least one pitch-retaining pipe rise 123 provided with an aforesaid main buffer-tank 105 with at least one vapor-phase direct-connection conduit 122 between the two systems or conduits 117, 118, the said vapor-phase direct-connection 122 interconnecting the upper point of the descending branch 101 of the said pipe rise 123 with the live-vapor admission conduit 117. The buffer-tank 105 is placed at the low point of the pipe rise 123, the descending vertical branch 101 of which opens into the upper portion or the vapor-phase space of the buffer-tank through the check valve 20' and the ascending vertical branch 106 of which enters the tank 105 so that its lower open free end opens therein substantially in proximity to the bottom of the buffer-tank the said rising branch 106 being provided with a check valve 126. In addition, the buffer-tank is equipped with an aforesaid heating means 140 such as a heating resistor or the like, connected through a remote-control transmission 124 to a level controller 107. The difference in level $h_a$ between the respective upper points of the descending vertical branch 101 and the rising vertical branch 106 of the pipe rise 123 defines the geometrical height of rise of the condensates in order to pass from the down-stream portion to the up-stream portion of the condensate return conduit 118, whereas the difference in level $h_b$ between the lower end of the up-stream portion and the upper end of the down-stream portion of this condensate return conduit 118 defines the value of the pitch-retaining rise of this condensate gravity-flow pipe, and the difference in level H between the minimum level of the condensate always maintained in the buffer-tank 105 by the level controller 107 and the upper point of the ascending branch 106 of the pipe rise arrangement 123 (at the up-stream end of the inclined stepped connecting portion 102 of the conduit 118) defines the total height of rise of the condensates, which is substantially equivalent to the over-pressure to be reduced by the thermodynamic pumping effect in the buffer-tank 105. This arrangement is characterized by an aforesaid vapor discharge conduit 141 connecting the top or vapor-phase space of the buffer-tank 105 to the vapor-phase direct-connection conduit 122 and containing the motor-actuated isolating valve 142, the servo-motor of which is connected by a remote-control transmission 143 to the monitoring member of the level controller 107. This vapor discharge conduit 141 shown in dotted lines in FIG. 5 is optional.

Figure 6:
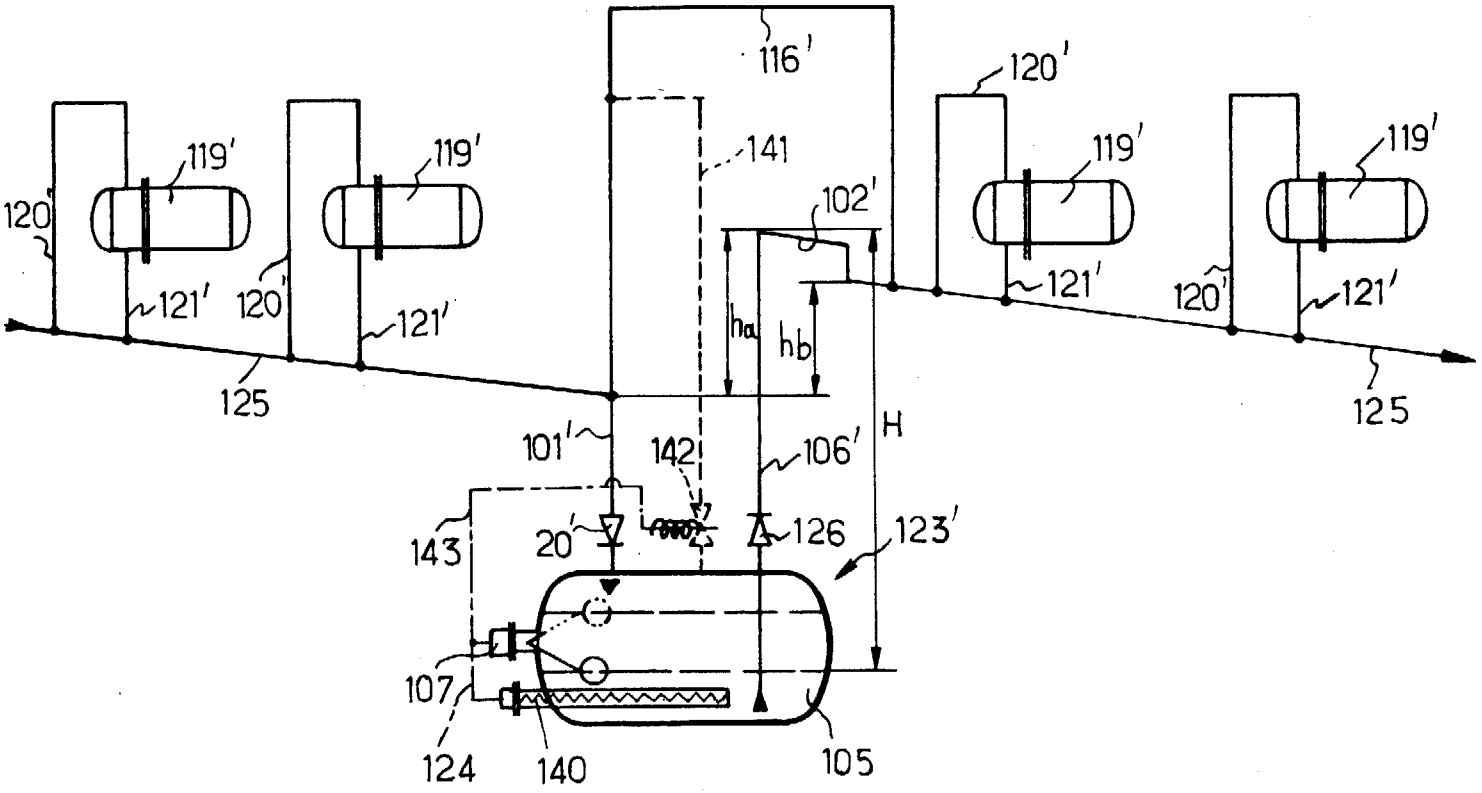
FIG. 6 is a view similar to FIG. 5, but illustrating the application of the thermodynamic pump to the case of a single-pipe network.

FIG. 6 illustrates a similar application of the same principle to a single-pipe system comprising at least one single common inclined conduit 125 for the admission of live vapor and the descending return of condensates by gravity, to which user or consumer apparatus 119' are connected in derivation through their vapor inlet pipe and condensate outlet pipe 120' and 121', respectively, the said common line 125 being provided with a pitch-retaining pipe-rise arrangement 123' including the same elements with the same definitions as in the foregoing Figure. A vapor-phase upper derivation loop 116' by-passes this pipe-rise arrangement 123' to connect the upper point of the descending vertical branch 101' of the latter to a point located down-stream of the said pipe-rise arrangement, towards the up-stream end of the down-stream portion of the common conduit 125 (between the step of the inclined pipe 102' connecting the rising or down-stream branch of the pipe-rise arrangement and the point of connection of the vapor inlet pipe of the first down-stream user apparatus 109'). This arrangement is characterized by an aforesaid vapor-discharge optional conduit 141 connecting the top of the buffer-tank 105 to the piping loop 116' and containing a motor-actuated stop-valve 142 remote-controlled by means of the transmission 143 by the level controller 107.

Figure 7:
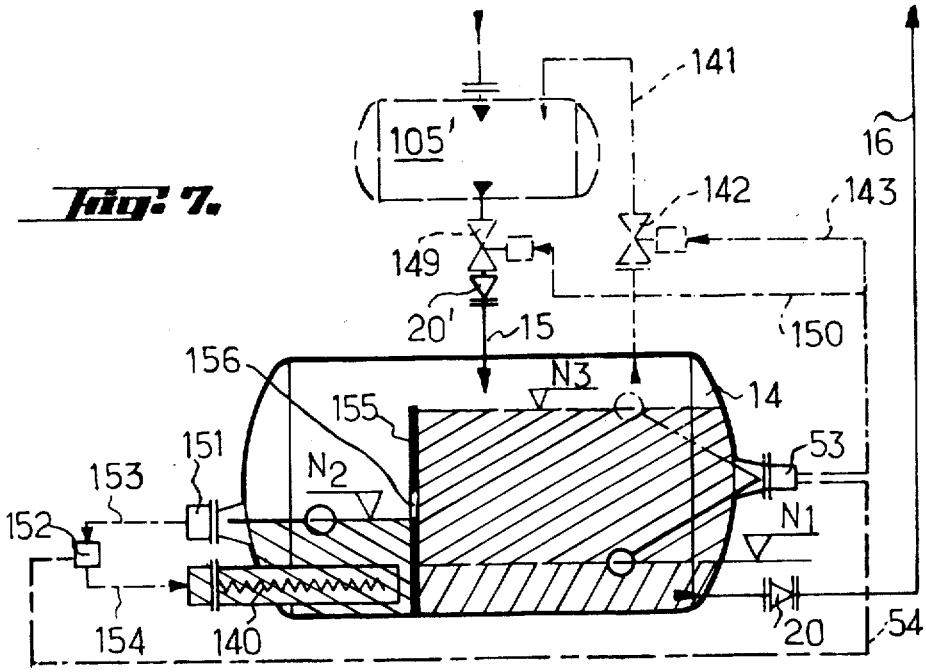
FIG. 7 illustrates a modified form of embodiment of the device of the foregoing Figure, showing the partial partitioning of the said main buffer-tank, with a heating of only the amount of liquid to be vaporized.
Figure 11:
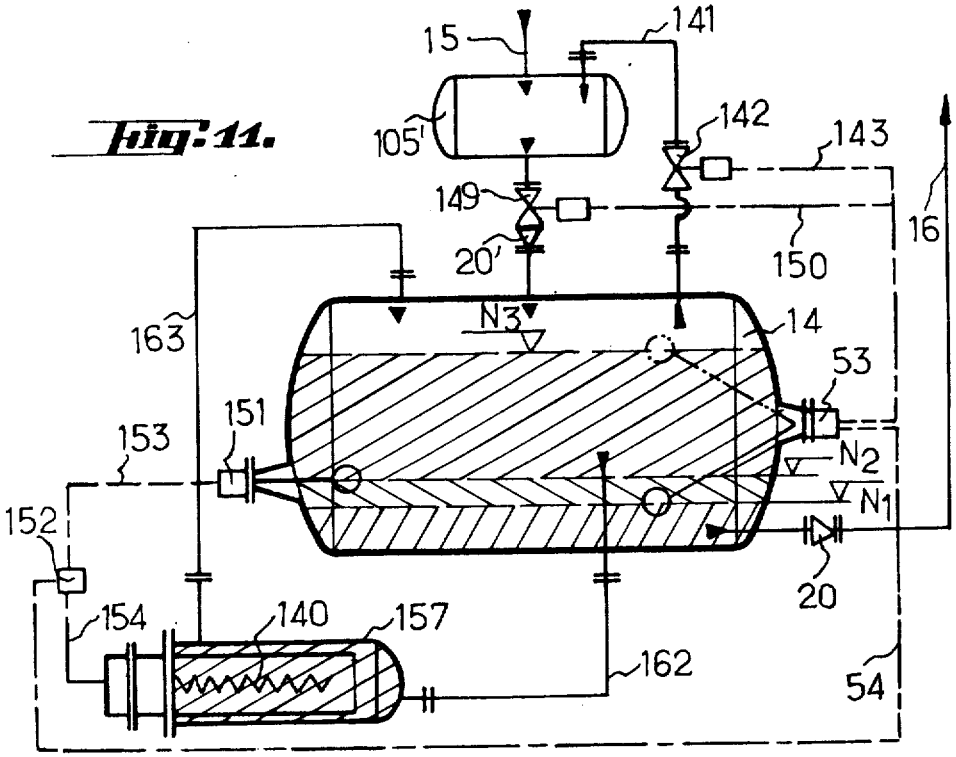
FIG. 11 shows a modification of the principle illustrated in FIGS. 7 to 10, using an external separate independent vapor generator feeding the said main buffer-tank with forcing vapor and withdrawing from the latter the necessary amount of liquid to be vaporized.

As previously mentioned the power consumed by the thermodynamic pumping (i.e. the calorific power to be supplied by the heating means 140 such as a heating resistor or the like) is considerably higher than the power consumed by a usual mechanical delivery or forcing pump offering the required flow-rate and pressure performances. According to the invention it is possible to reduce by an important proportion (e.g. more than 60%) the calorific power to be furnished to the condensates to ensure the thermodynamic pumping by heating only the strictly necessary amount of water to be vaporized, the result being a reduction of the total cost of the energy necessary for the pressure increase to be obtained in order to force the condensates out of the buffer-tank, as well as a reduction of the time required by the thermodynamic pumping effect to accomplish an operating cycle. To this end, the method according to the invention, in order to put this idea into practice, is characterized by an early heating beginning as soon as the condensates in the aforesaid container forming a main buffer-tank reach a given intermediate filling level lower than the aforesaid maximum level. This is obtained, according to another feature of the method of the invention, by a physical separation of the volume, in particular the strictly necessary volume, of condensates to be vaporized from the volume of condensates to be delivered and by the exclusive heating of the said volume of condensates to be vaporized which is either isolated and heated within the said buffer-tank container itself or conveyed into and heated in an external adjunct container, the vapor thus produced being preferably conveyed directly into the space above the free surface plane of the liquid condensates to be delivered, and a minimum amount of condensates to be heated being retained in the buffer-tank. This method may be carried out by using any one of the arrangements illustrated in FIGS. 7 to 11, respectively. Each of the arrangements shown in FIGS. 7 to 11, respectively, may comprise an isolating valve 149 mounted towards the down-stream end of the condensate gravity-return conduit 15 opening into the main buffer-tank 14, in particular between the latter and the auxiliary buffer-tank 105', should the latter be provided. According to one feature of this arrangement, the isolating valve 149 is mounted in series with the corresponding aforesaid check valve 20' upstream of the latter and is motor-operated, its servomotor being connected through a remote-control transmission 150 to the monitoring member of the level controller 53 of the buffer-tank 14. As shown in FIGS. 7 and 11, the buffer-tank 14 is advantageously provided with an additional intermediate level controller 151 and, according to another characteristic feature of this arrangement, the respective monitoring members of the intermediate level controller 151 and of the maximum and minimum level controller 53 are connected to the switching or start-stop member of the said heating means 140 through the medium of a common pilot relay 152 by means of a respective remote-control transmission 153, 54 and 154 (connecting both level controllers to the pilot relay 152 and the latter to the heating means 140, respectively).

In the form of embodiment according to FIG. 7, the afore-mentioned physical separation of the condensates is obtained by means of a partial internal partition wall 155 provided in the main buffer-tank 14 and extending upwardly from the bottom of this buffer-tank up to a definite height corresponding to a maximum level $N_3$, thus subdividing the buffer-tank 14 into two unequal sections communicating with one another in the upper portion, i.e. the vapor-phase space, of the buffer-tank. This partition wall is provided with at least one interconnecting through-orifice 156 located substantially at the intermediate level $N_2$ defined by the relative position of the additional intermediate level controller 151, whereas the heating means 140 is placed in the base portion of the smaller section, the capacity of which corresponds to the necessary minimum amount of liquid to be vaporized. Each small through-orifice 156 provided in the partial partitioning wall 155 is therefore located above the heating means 140 and thus allows the said smaller section to be fed with liquid water (condensates), whereas the empty space in the upper portion of this smaller section allows for the free upward passage of the vapor and its introduction above the free surface plane of the condensates to be delivered filling the said larger section (on the right-hand side of the partition wall 155 in FIG. 7). In the example according to FIG. 7, the heating means 140 must heat the whole water volume contained in the smaller section located on the left-hand side of the wall 155. Now this volume is still usually greater than the exact amount of liquid to be converted into vapor in order that the condensates may be delivered under a higher pressure. In order to additionally reduce this volume of water to be evaporated and according to another feature of this arrangement, shown in FIGS. 8 to 11, the heating means 140 is placed in a closed enclosure 157, the capacity of which is substantially equal to the exact volume of liquid to be vaporized (to thus form an individual vapor generator) and the respectively lower and upper portions of which communicate with the lower and upper portions, respectively, of the main buffer-tank 14, at least a lower portion of the enclosure 157 being located substantially at the level of the said lower portion of the buffer-tank 14 or lower than the said level.

Figure 8:
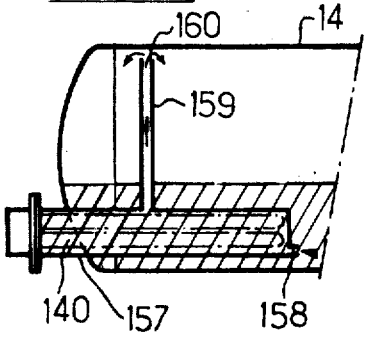
FIG. 8 is a fragmentary view, to a smaller scale, of the main buffer-tank showing another form of embodiment of the principle, illustrated in FIG. 7, using a submerged internal horizontal tubular auxiliary vapor generator communicating directly, on the one hand, with the liquid phase and, on the other hand, with the vapor phase.
Figure 9:
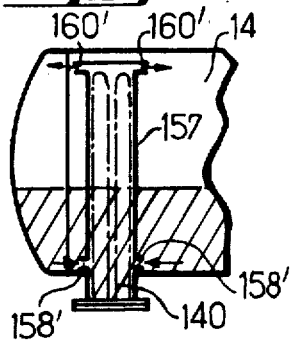
FIG. 9 is a view similar to FIG. 8, showing a modified form of embodiment with a vertical tubular vapor generator mounted through the bottom and partially emerged.
Figure 10:
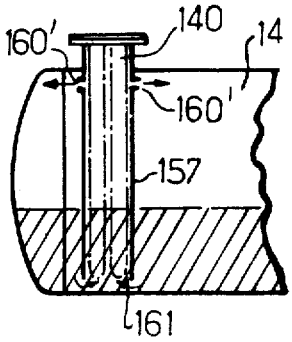
FIG. 10 is a view similar to FIG. 9, but showing the vapor generator mounted through the top of the main buffer-tank and partially immersed.

According to the forms of embodiment illustrated in FIGS. 8 to 10, the aforesaid individual vapor generator 140, 157 is located within the main buffer-tank 14, in particular in proximity to the bottom of the latter, and is provided with an elongated hollow casing, for example cylindrical in shape, forming the aforesaid enclosure 157 and placed for example horizontally as shown in FIG. 8, with at least one lower communication orifice 158 opening for example towards the free end of the said casing and a vertical open communication conduit or flue 159 extending from the upper portion of the casing 157 up into the upper, vapor-phase space of the buffer-tank 14, thus allowing this space to constantly communicate with the internal cavity of the enclosure 157. The capacity of the latter is relatively small and the orifice 158 in its lower portion allows the inflow of water, whereas the vapor produced within the enclosure 157 rises through the tubular flue 159 and escapes through its upper end orifice 160 opening in proximity to the top of the buffer-tank into the vapor-phase space of the latter. The cylindrical heating body 157 penetrates laterally into the buffer-tank 14 through the end transverse wall of the latter as seen in FIG. 8.

In the forms of embodiment of FIGS. 9 and 10, the cylindrical heating body 157 with its internal heating element 140 is placed vertically and penetrates (in a fluid-tight manner) into the buffer-tank 14 either upwardly by passing through the lower bottom of the latter as in FIG. 9 or downwardly by passing through the top of the buffer-tank 14 as in FIG. 10. In the variants of embodiment of FIGS. 9 and 10, the introduction of liquid into the heating body takes place through one or several orifices 158' passing through the lower portion of the heating body 157 (FIG. 9) or through the open lower end 161 of the heating body 157 (FIG. 10), this lower portion being sunk or immersed in the condensates, whereas the outflow of the vapor produced in the heating body 157 takes place through one or several orifices 160' passing through the wall of the upper portion of the heating body 157 into the vapor-phase space of the buffer-tank 14.

In the form of embodiment according to FIG. 11, the heating means, forming an individual or autonomous vapor generator (comprising the enclosure 157 and the heating element 140), is placed outside the main buffer-tank 14, and the lower and upper portions, respectively, of its enclosure 157 are connected through respective conduits 162, 163 to the corresponding lower and upper portions, respectively, of the buffer-tank 14. In this form of embodiment, heating means is located at a lower level than the buffer-tank 14, and the conduit 162 proceeding from the lower portion of the enclosure 157 penetrates in a fluid-type manner through the base of the buffer-tank 14 and extends therein vertically up to a height corresponding substantially to the afore-mentioned intermediate level $N_2$ defined by the relative position of the intermediate level controller 151, whereas the conduit 163 connects the upper portion of the enclosure 157 to the top of the buffer-tank 14.

It should be noted that, in the forms of embodiment illustrated in FIGS. 7 and 11, the presence of the auxiliary buffer-tank 105' of the isolating valve 149 with its remote-control transmission 150, of the intermediate level controller 151 and of the pilot relay 152 with the associated remote-control transmission 153, is optional. The operation of these arrangements is as follows: when, during the filling of the main buffer-tank 14, the condensates therein reach the upper level $N_3$ (corresponding to the position in height of the upper end edge of the partition wall 155, for example in FIG. 7) the level controller 53 ensures the opening of the valves 142 and 149 as well as the operation of the heating means 140. This heating of the condensates results in a pressure rise in the vapor-phase space above the plane of the condensates in the main buffer-tank 14 and, when the final pressure is reached therein, the condensates are automatically forced out through the piping 16 running from the base of the buffer-tank 14, through the check-valve 20. It should be noted that, in the case of FIG. 11, the enclosure 157 of the heating body is filled automatically through the conduit 162 when the condensates in the buffer-tank 14 reach and rise above the intermediate level $N_2$ of the upper end orifice of this conduit. When, during the delivery, the level of the condensates lowers in the buffer-tank 14 to the lower limit level $N_1$, the level controller 53 ensures successively the opening of the valve 142 (in order to decrease the pressure in the buffer-tank 14 to the value of the pressure in the up-stream system or in the auxiliary buffer-tank 105' by discharging the vapor through the conduit 141), and then the opening of the valve 149 after the equalization of the pressures causing the delivery to stop. The condensates in the up-stream system are momentarily stored in the auxiliary buffer-tank 105' may then again enter the buffer-tank 14 by gravity through the check valve 20' (released by the pressure equalization) and fill the buffer-tank 14 until the level in the latter reaches the upper level $N_3$, thus starting a new cycle or operation.

The afore-mentioned sequence of operations takes place when there is only one level controller 53 on the main buffer-tank 14, the upper limit position $N_3$ and the lower limit position $N_1$ of the detecting member or float of which determine the beginning of the period of heating and delivery of the condensates, respectively.

According to a variant of embodiment, the adjunction of an additional intermediate level controller 151 on the main buffer-tank 14 and of the pilot relay 152 allows the heating means 140, 157 to be started as soon as the rising level of the condensates reaches the intermediate level $N_2$, thus allowing the tempo of the periodical cycles, i.e. the rate or frequency of the repetitive intermittent operations to be accelerated, by beginning to heat the condensates to be evaporated before the main buffer-tank 14 is filled up to the upper level $N_3$.

Figure 12:
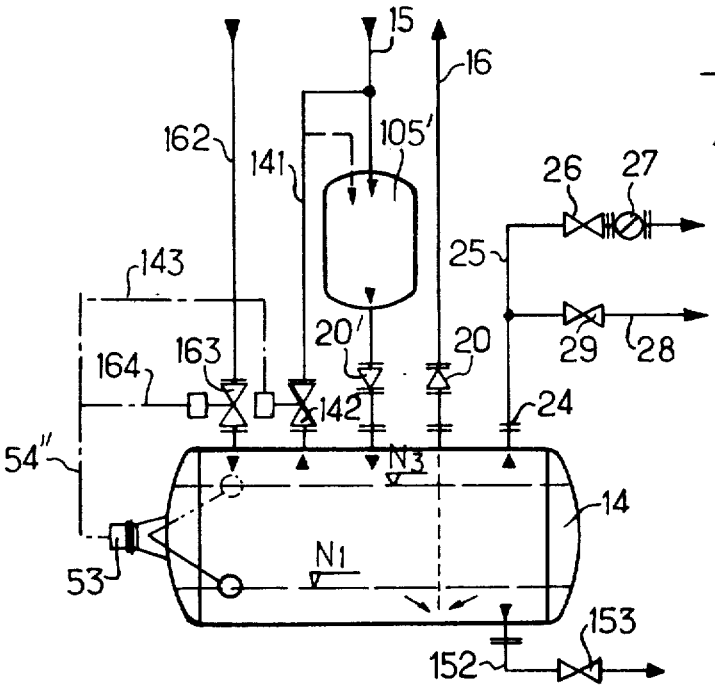
FIG. 12 is an isolated fragmentary view of a main condensate-collecting buffer-tank equipped with a system of introduction of external live force-pumping vapor.
Figure 13:
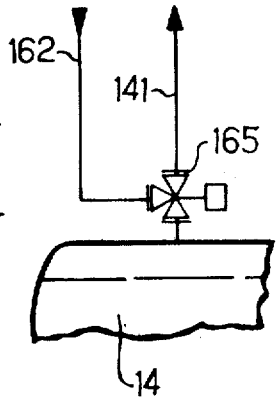
FIG. 13 is a partial view of the said main buffer-tank in which the live-vapor intake valve and the pressure release valve shown in the foregoing Figure are replaced by a three-way valve.

FIGS. 12 and 13 illustrate another way of producing a condensate delivery pressure in a main buffer-tank 14, as a variant of the aforesaid method, which is characterized by the introduction into the upper, vapor-phase space of the main buffer-tank 14 of an external live-vapor input under a higher pressure than the one existing in the up-stream system of gravity-return of the condensates or in an auxiliary buffer-tank 105' possibly provided for momentary storage of the condensates. In order to carry out this method, the upper portion of the main buffer-tank 14 is connected by at least one live-vapor admission conduit 162 to an appropriate live-vapor generating or feed source. If the pressure of the saturated vapor located above the plane of the free surface of the condensates in the closed container constituted by the partially filled main buffer-tank 14 is thus increased by introducing live vapor under a higher pressure than the one initially existing in this container, it is possible, owing to this increase in pressure, to force out the condensates from the lower portion of the buffer-tank 14 through the piping 16 penetrating into the buffer-tank down to a point located in proximity to the lower bottom of the latter. In this case, there necessarily occurs a heat transfer from the high-pressure vapor introduced into the buffer-tank 14 to the vapor and the condensates at a relatively lower pressure initially contained in this buffer-tank. The live-vapor admission conduit 162 is provided with an isolating valve or the like 163 which is preferably motor-actuated and has its servo-motor connected to a remote-control transmission 164 to the level controller 53 mounted on the main buffer-tank 14. The valve 163 may also be a hand-actuated obturating member or an electromagnetically controlled valve or a valve actuated by an auxiliary fluid under pressure or a like closing member provided on the high-pressure vapor admission. In addition, the arrangement comprises the other accessories already mentioned previously, namely one or several conduits 15 for the admission by gravity of condensates under a relatively low pressure; a closing member on each condensate admission conduit, such as a non-return valve 20' or an obturating member actuated manually or controlled automatically, either remotely or not (e.g. an electromagnetic valve, a motor-operated valve, a valve controlled by an auxiliary fluid under pressure, etc.); a closing member on the condensate delivery piping 16', such as a check valve 20 or a member of one of the other types mentioned hereabove. The auxiliary buffer-tank 105' placed up-stream of the obturating member 20' provided at the inlet of the condensates into the main buffer-tank 14, is optional and is intended to temporarily contain the condensates arriving during the period when the obturating member 20' is closed. The main buffer-tank 14, instead of having a single level controller 53, may be provided with several such condensate level controllers controlling the opening and closing cycles of the various obturating members. The vapor-phase connecting piping 141 provided between the confined space located above the condensate water plane in the main buffer-tank 14 and the condensate gravity-return system 15 up-stream of the obturating member 20' may be connected to the conduit 15 or open directly into the auxiliary buffer-tank 105', if any. The purpose of this connecting piping is to ensure an immediate pressure decrease in the main buffer-tank 14 on the ending of the delivery under pressure of the condensates contained therein, but this connecting piping may also, if suitable, open into another system at a sufficiently low pressure. The closing member constituted by the isolating valve 142 on this relief piping (relief through vapor discharge) is intended to allow the vapor to be discharged only after the end of the period of condensate delivery and it may be, for example, of one of the types used for the admission of vapor under relatively high pressure. Lastly, the aforesaid arrangement is equipped with the other usual accessories such as isolating valves for cutting off the various connections, devices for by-passing the various obturating member, emptying or draining cocks and pipes, manual and automatic bleeding means for the noncondensable substances.

FIG. 13 illustrates a variant of the form of embodiment of FIG. 12, in which the valves 142 and 163 on the conduits 141 and 162, respectively, are replaced by a single three-way valve 165 fulfilling the same functions as both valves 142 and 163.

The operation of this arrangement is as follows, assuming that, initially, the main buffer-tank 14 contains no condensates, the valve 142 is open and the valve 163 is closed: the condensates proceeding by gravity through the condensate return conduit or from the auxiliary buffer-tank 105' flow into the main buffer-tank 14 through the unidirectional closing member 20' constituted, in this case, by a check valve, thus starting the filling of the buffer-tank 14. When the condensates in the latter reach the upper level $N_3$, the level controller 53 ensures simultaneously the opening of the obturating member 163 on the live-vapor admission conduit 162 and the closing of the valve 142, thus allowing live vapor under high pressure to penetrate into the upper space of the buffer-tank 14. As soon as the pressure in the latter is sufficiently high, it stops the gravitational inflow of the condensates by locking the check valve 20' in the closed position. The check valve 20' may be replaced, if suitable, by a shut-off gate remotely controlled by the level controller 53. Thereafter, since the pressure continues to increase in the confined vapor-phase space of the main buffer-tank 14, it overcomes the counter-pressure existing in the condensate delivery system 16, so that the condensates contained in the main buffer-tank 14 are delivered through the check valve 20 and the piping 16. The check valve 20 may also be replaced by a stop-gate remotely controlled by the controller 52 to be either opened or closed thereby. During the condensate delivery period, the main buffer-tank 14 empties and when the level of the condensates therein reaches the lower or minimum level $N_1$, the level controller 53 ensures the cutting-off of the live-vapor admission by causing the gate 163 to close and simultaneously opens the gate 142 on the pressure balancing conduit 141, so that the pressure in the main buffer-tank 14 decreases to the value of the pressure in the up-stream condensate-intake system 15, 105'. When this balancing of the pressures is achieved, the check valve 20' is released, so that the condensates proceeding from this up-stream condensate gravity-return system are again allowed to flow freely to enter the main buffer-tank 14 and to fill the same up to the maximum level $N_3$, thus starting a new operating cycle.

There are already known, in the prior art, compressed gaseous power-fluid (compressed air or vapor) pumps of the so-called float type, which are generally used as condensate lifting devices, but not as condensate readmitting devices. In this known device, the liquid condensate to be delivered is admitted by gravity to the pump body through a check valve and progressively raises the float until the latter closes directly an escape valve and simultaneously opens an inlet valve, e.g. a live-vapor inlet valve, thus allowing the vapor to flow into the upper portion of the pump body under a higher pressure than the desired delivery head; this pressure results, on the one hand, in keeping the escape valve closed and, on the other hand, in expelling the liquid condensate by forcing the same through a check valve and, finally, in locking the condensate admission check-valve in the closed position. The pump body then empties, thus causing the float to lower, the escape valve to open automatically and the live vapor inlet valve to close simultaneously, so that the pressure in the pump decreases and releases the condensate admission check-valve, thus allowing the condensates to again enter the pump while the condensate delivery check-valve is kept closed and a new cycle starts. The vapor pump designed according to the invention and shown in FIG. 12 offers the following advantages over the known pump just described:

The known pump is applicable only to condensates whose temperature must be lower than 95° C., since the condensate flow system up-stream of the pump is periodically connected with the external atmosphere. On the contrary, the vapor pump according to the invention can be used where the temperature of the condensates is higher than 100° C. and is designed for vapor at a pressure and a temperature which are substantially constant within each system, without any separation of the phases, i.e. of the vapor condensates. Consequently, the said known pump can operate only because the condensate return systems are provided with condensed-water bleeder or drain means. Indeed, if the live vapor were allowed to reach the known pump by following the condensate admission path, the internal float of the pump would not respond and would therefore remain in its lower position, thus leaving open the vent orifice located in the upper position. All the vapour which might enter the pump through the condensate admission piping would then be allowed to escape through this orifice. On the contrary, the vapor pump according to FIG. 12 operates perfectly even when the condensate gravity-intake piping contains simultaneously vapor and condensates. Since the whole arrangement is integrated in a completely closed circuit, there can be no escape of vapor.

In the known vapor pump, all the live vapor used to deliver the condensates under pressure is lost, since it escapes to free air after accomplishing the required work. On the contrary, in the pump according to the invention, the totality of the power live vapor used for the delivery of the condensates is recovered. Furthermore, in the said known pump, the condensates upstream of the pump are necessarily made to communicate with the open air, thus inevitably causing all the live vapor losses which may pass through the bleeders, as well as all the vapor resulting from the self-vaporization due to the opening of the hot condensates to the open air, to be discharged to the atmosphere. On the contrary, in the vapor pump according to the invention, since the latter is mounted in a closed-circuit plant, therefore does not communicate with the atmosphere, no live vapor loss can occur.

The known vapor pump is applicable only to low-pressure plants in which the up-stream condensates are at the same pressure and temperature as the surrounding atmosphere. On the contrary, the new vapor pump according to the invention may be used within any range of pressures (provided power live vapor at a sufficiently high pressure is available). Moreover, the maximum condensate delivery head of the said known pump is limited to a water column about 15 m in height. On the contrary, the new pump according to the invention, is capable of providing any delivery head compatible with the available power live vapor pressure.

In the known vapor pump, the various sequences of opening and closing of the passage orifices are mechanically interlocked with the position of the internal float of the pump. On the contrary, the new pump according to the invention comprises a certain number of independent members (level controller, remote-controlled members and so forth) which may be programmed differently according to the nature of the problem to be solved.

If the condensates of the main buffer-tank 14 must be delivered to a place where the pressure is higher than that of the said power live vapor used for the pumping, it is advantageous, according to another feature of the method of the invention, to provide a combination of the introduction of the power live vapor onto the said main buffer-tank with the aforementioned vaporizing heating of at least part of the said condensates, in such a manner that the total vapor pressure thus produced in the said main buffer-tank be at least equal to the necessary delivery pressure. In this case, the said main buffer-tank is for example connected, by its lower portion by means of a delivery conduit, to a vapor generating boiler or to a system of lines at a higher pressure than that of the said power live vapor, and, to this end, the arrangement allowing this variant of the method to be carried out is characterized in that it comprises both the aforesaid vaporizing heating means 140 according to one of FIGS. 1 to 11 and the live vapor admission conduit 162 (according to FIG. 12 or 13) connecting the upper portion of the main buffer-tank 14 to a live vapor supply, to thus constitute a combined pumping sub-station.

Such a combined arrangement may advantageously be used for example in the following case: When the condensates under a pressure of for example, 2 bars must be delivered to a place where the pressure is 15 bars, and if the available live vapor is at a pressure of only 14 bars, use is then made of a pumping by means of the power live vapor at 14 bars, which is completed by a thermodynamic pumping effect by heating the condensates, e.g. electrically, to produce the lacking 1-bar pressure in order to obtain the necessary final delivery pressure of 15 bars.

The various foregoing forms of embodiment or parts of the latter, may of course be combined and associated with one another in different manners in closed-circuit vapor systems or networks with direct reintroduction of the condensates into the boilers, the working fluid being everywhere at a temperature and a pressure which are substantially or at least approximately constant and identically the same at all points of the said systems or networks (disregarding flow pressure losses and casual cooling) which are generally completely deprived of any vapor or condensate bleeder, drain or like phase-separating devices.

Figure 14:
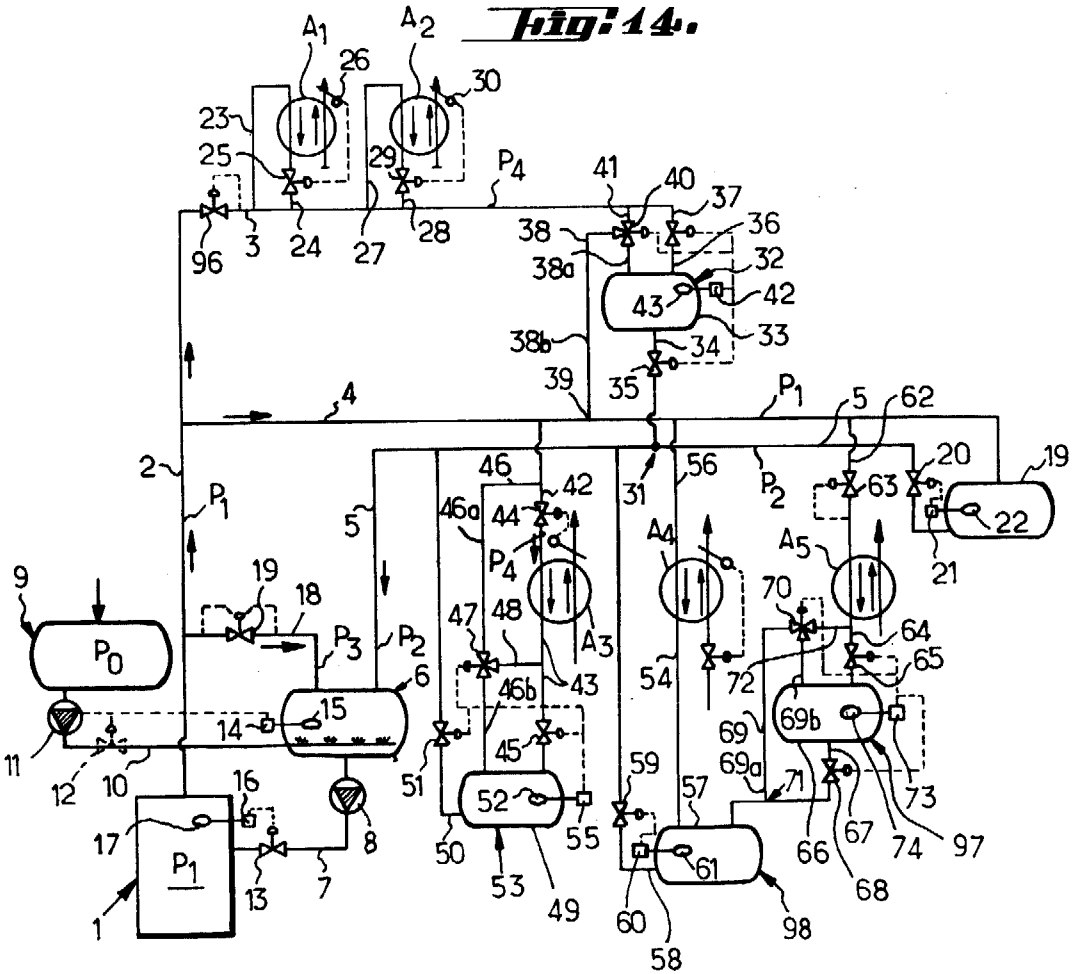
FIG. 14 is a diagrammatic view of a closed-circuit plant for producing, distributing and utilizing vapor, with return of the condensates to the boiler, according to a form of embodiment of the present invention, the said plant employing only two pumps and using a single condensate collecting tank situated at any level with respect to the boiler.

The plant of FIG. 14 comprises a vapor-generating boiler 1, a live-vapor distributing system constituted by the main vapor-distribution line 2 and the secondary vapor-distributing lines 3 and 4, a system for the return of the condensates formed in the consumers supplied with the said live-vapor, the said condensate return system being constituted essentially by the condensate return line 5 and the condensate collecting tank 6, a line 7 for readmission of the condensates from the collecting tank 6 into the boiler by means of the condensate readmission pump 8, a certain number of vapor consumers, five in number in the case considered, denoted by the reference letters $A_1$, $A_2$, $A_3$, $A_4$ and $A_5$, a feed tank 9 supplying make-up water to the boiler through the make-up water feed line 10, by means of the feed pump 11.

The make-up water feed line 10, possibly provided with a valve 12, connects the feed tank 9 with the condensate collecting tank 6, so that no provision is made for direct feeding of the boiler with make-up water, the said make-up water being supplied from the condensate collecting tank 6 only through the condensate direct readmission line 7 provided with the valve 13. The pump 11 and the valve 12, if any, are controlled by a regulator 14 connected with a member 15 for detecting the height of the water surface in the collecting tank 6; the valve 13 of the condensate readmission line 7 is controlled by a regulator 16 connected with a member 17 for detecting the water level in the boiler 1. The pressure, except for the pressure losses in the line, and the temperature in the live-vapor distributing system are constant, the pressure in this system being denoted by $P_1$. The pressure, except for the pressure losses in the line, and the temperature are constant also in the condensate return system, this pressure being denoted by the reference letter $P_2$; The higher pressure $P_1$ is of the order of, for example, 20 bars, whereas pressure $P_2$ is for example 17 bars.

According to the first form of embodiment illustrated in FIG. 14 the condensate collecting tank 6 is directly connected with the live-vapor distributing system through a vapor supply conduit 18, itself connected with the main vapor distributing line 2; the conduit 18 is provided with a pressure-reducing valve 19, the function of which is to reduce the pressure $P_1$ by such an amount that the value $P_3$ of the pressure downstream of the valve 19 is higher than the pressure corresponding to the temperature of the condensates on the saturation vapor tension curve (pressure of self-vaporization of the said condensates). Although the condensate return system is at pressure $P_2$, direct admission of cold water into the collecting tank 6 through the make-up water feed line 10 results in a lowering of the temperature of the condensates in the collecting tank 6, so that the said pressure of self-vaporization within the said collecting tank is a little inferior to the pressure $P_2$. The value of the selected pressure $P_3$ may therefore be equal to pressure $P_2$, e.g. of the order of 17 bars in the example considered.

Under such conditions, and as pointed out above, any consideration of geographical height as regards the collecting tank 6 becomes unnecessary since the available NPSH is very high and therefore permits the use of a pump 8 of any required NPSH, thus at the same time permitting the avoidance of any tendency to cavitation and the use of a pump that is sturdy, inexpensive and has the desired output, even if it is very high.

The vapor that is not used in the consumers $A_3$ to $A_5$ connected to the secondary vapor distributing line 4 cannot flow beyond the tanks 19, which play the role of a limit drain; this tank communicates at its lower portion with the condensate return line 5 and the fluid inflow into this line is regulated by the valve 20 controlled by the regulator 21 connected to the member 22 for detecting the water level in the tank 19. When the valve 20 is open the fluid naturally flows into the condensate return system since the pressure $P_1$ acting upon the water surface in the tank 19 is higher than the pressure $P_2$ prevailing in the condensate return system; the tank 19 and its accessories therefore constitute flow lock means of the type described above.

The connection of consumers $A_1$ and $A_2$ in the system is monotubular, which means that the condensates proceeding from the said consumers flow through the same line as the live vapor, e.g. through the secondary vapor distributing line 3. The consumer $A_1$, which is for example a heat exchanger, receives live vapor from the secondary line 3 through the medium of the live-vapor supply conduit 23, whereas the condensates issuing from the consumer $A_1$ are directed to the secondary line 3 through the medium of the condensate outlet conduit 24 provided with the valve 25 automatically controlled by a regulator 26.

Likewise, the consumer $A_2$ is connected with the secondary vapor distributing line 3 through the live-vapor supply conduit 27 and the condensate outlet conduit 28 on which is mounted the valve 29 automatically controlled by the regulator 30.

The fluid circulating in the downstream portion of line 3 is returned at 31 to the condensate return line 5 through a device 32 constituting a vapor pump of the type described above. This vapor pump comprises a tank 33, a condensate outlet conduit 34 provided with a valve 35, a condensate inlet conduit 36 provided with a valve 37 and a vapor injection conduit 38 connected, on the one hand, with the secondary vapor distributing line 4 at 39, and on the other hand, with the vapor pump through the medium of a three-way valve 40 the third way of which is connected with the line 3 through a piping 41; the three-way valve 40 and the two-way valves 35 and 37 are controlled by servo-motors connected with a regulator 42 receiving the indications of a member 43 for detecting the height of the water level in the tank 33.

In a manner known per se, the vapor pump 32 of FIG. 14 operates in the following manner: the two-way valve 35 being closed and the three-way valve 40 being so placed as to prevent vapor injection into the line 38 but to permit the direct passage of the condensate from the line 3 to the tank 33 through the piping 41 and the upstream portion **38*a* of conduit 38, whereas the two-way valve 37 is open, the condensates may freely enter the tank 33 by simple gravity; when a sufficient level is reached in the tank 33, the regulator 42 acts upon the valves 35, 37 and 40 to cause the upstream portion 38*b* of the conduit 38 to communicate with the downstream portion 38*a* of this same conduit, the communication with the piping 41 to be cut off and the valves 35 and 37 to be closed. The vapor supplied through the vapor injection conduit 38 is at a pressure $P_1$ of the order of 20 bars, i.e. superior to the pressure prevailing in tank 33 during its filling, that is to say, to the pressure $P_4$ in the line 3, (obtained by means of the pressure reducer 96), e.g. of the order of 10 bars; on the other hand, the pressure in the condensate outlet conduit 34 connected at 31 to the condensate return line 5 is the pressure $P_2$, of the order of 17 bars, i.e. a little lower than pressure $P_1$. As a result, the condensates collected in the tank 33 are expelled into the condensate return line 5, and thereafter the operating cycle of the vapor pump 32** may start over again.

The vapor consumer $A_3$ is supplied with vapor at the pressure $P_1$ through the vapor inlet conduit 42. The function of valve 44 is to modulate the vapor intake into the consumer $A_3$ in dependence of the need for heated secondary fluid in the said consumer. The pressure downstream of the valve 44 is therefore equal or lower than the pressure $P_1$, say $P_4$. The condensate formed in that consumer is recovered by the condensate outlet conduit 43 provided with a valve 45. A vapor injection conduit 46 branching off from a point upstream of the valve 44 comprises an upstream portion **46*a* and a downstream portion 46*b* separated by a three-way valve 47, one of the ways of which is represented by the piping 48 connected with the conduit 43 upstream of the valve 45. The conduits 43 and 46 are connected with the tank 49, as illustrated, the latter being connected to the condensate outlet conduit 50 connecting with the condensate return line 5 provided with a valve 51. The three-way valve 47 and the two-way valves 45 and 51 are actuated by a regulator 55 connected with the member 52 for detecting the height of the water level within the tank 49, which, together with its accessories, constitutes a vapor pump 53 whose operation is similar to that of the previously described vapor pump 32**.

This vapor pump serves to transfer the condensates from the system at the pressure $P_4$ to the condensate return system at the pressure $P_1$ prevailing downstream of the tank 49, on the condensate outlet conduit 50. The vapor pump 53 operates as follows: the valve 51 being closed and the valve 45 being open, the three-way valve 47 is in the position in which the downstream portion **46*b* of the vapor injection conduit 46 communicates with the pipe 48, so that the condensates at the pressure $P_4$ may enter the tank 49 through both the conduit 43 and the pipe 48 and then the downstream portion 46*b* of conduit 46. When the liquid level within the tank 49 has reached the maximum admissible value, the regulator 55 actuates the motorized valves 45, 47 and 51 to close the valve 45, open the valve 51 and cause the downstream portion 46*b* of the conduit 46 to communicate with the upstream portion 46*a* of that conduit, so that vapor at the pressure $P_1$ is admitted above the water surface in the tank 49 and expels the condensates from that tank into the condensate outlet conduit 50, after which the operating cycle of the vapor pump 53** starts again.

The vapor consumer $A_4$ is supplied through the vapor inlet conduit 56 and the condensate issuing from the consumer $A_4$ is directed to the tank 57 through the condensate outlet conduit 54. The condensate from the tank 57 is returned into the condensate return line 5 through the condensate outlet conduit 58 provided with a valve 59 of the motorized type controlled by the regulator 60 connected with the member 61 for detecting the height of the water level in the tank 57. The tank 57 and its accessories form flow lock means 98 of the type already described. This device operates as follows: when a sufficient quantity of water has been admitted into the tank 57 permanently supplied by gravity through the conduit 54 in which the pressure is $P_1$, the regulator 60 causes the valve 59 to open so that the condensates can flow into the outlet conduit 50 where the pressure $P_2$ is lower than the pressure $P_1$.

The vapor consumer $A_5$ is supplied through the vapor inlet conduit 62 on which is placed a pressure-reducing valve 63 which reduces the vapor pressure to a lower value than $P_1$, e.g. to a value $P_2$ of 17 bars. The condensate outlet conduit 64 provided with a valve 65 is connected with a tank 66 situated at a higher geographical level than the tank 57. The outlet line 67 for the condensate from the tank 66 is provided with a valve 68 and connected with the tank 57. A vapor injection conduit 69 on which is mounted the three-way valve 70, connects a conduit 67, at a point 71 thereof located between the valve 70 and the tank 57, to the tank 66. One of the paths of valve 70 is constituted by the pipe 72 connecting with the outlet conduit 64 upstream of the valve 65. The two-path valves 65 and 68 and the three-path valve 70 are motorized valves controlled by the regulator 73 and connected with the member 74 for detecting the height of the water level in the tank 66. The tank 66 and its accessories constitute an admission lock means 75.

The admission lock means 75 allows the condensates proceeding from the consumer $A_5$ and at a lower pressure $P_2$ to be periodically admitted into a vessel where the pressure $P_1$ is higher, i.e., in the case considered, the tank 57. This admission lock means operates as follows: the valve 68 being closed, the valve 65 being open, the three-way valve 70 is in the position allowing the pipe 72 to communicate with the downstream portion **69*b* of the vapor injection conduit 69, thus permitting the filling of the admission lock means 75, on the one hand, through the condensate outlet conduit 64, and on the other hand, through the piping 72 and the downstream portion 69*b* of the vapor injection conduit 69. When the filling stage is over, the regulator 73 causes the valve 65 to close, the valve 68 to open and the three-way valve 70 to be switched so as to allow both portions 69*a* and 69*b* of conduit 69 to communicate with one another. The same pressure $P_1$ is then applied to both sides of the mass of water in the tank 66, so that, owing to the difference in geographical level between the tank 66 and the tank 67, this water may flow into the tank 57 through the condensate outlet conduit 67. When this filling stage is completed, the operating cycle of the admission lock means 75** may start again.

The plant according to the form of embodiment illustrated in FIG. 15 comprises a feed tank 9', the vapor generating boiler 1' and its main vapor distributing line 2', the main condensate return line 5', the two general condensate collecting tanks **6'*a* and 6'*b* and the condensate direct readmission line 7' constituted by the condensate outlet conduit 7'*a* from the tank 6'*a* and the condensate outlet conduit 7'*b* from the tank 6'*b*. The vapor consumers connected either to the vapor distributing system supplied through the line 2' (of monotubular type) or between this system and the condensate return system supplying the line 5' are not shown in FIG. 15. The reference numeral 76 denotes a line for the injection of vapor at the pressure $P_1$ prevailing in the vapor distributing system, which line branches out into a conduit 76*a* for vapor injection into the tank 6'*a*, and into a conduit 76*b* for vapor injection into the tank 6'*b*, these conduits being provided with three-way valves 77*a* and 77*b*, respectively. The condensate return line 5' is connected with the tanks 6'*a* and 6'*b* through condensate inlet conduits 78*a* and 78*b*, respectively, each provided with a valve 79*a* and 79*b*, respectively. Furthermore, the condensate return line 5' is connected with the vapor injection line 76 through a conduit 18' provided with a pressure-loss device such as a pressure reducing valve 19'**.

The feed tank 9' is connected with the collecting tanks **6'*a* and 6'*b* through the make-up water feed line 10' on which is mounted the feed pump 11' and which branches out into a feed conduit 11'*a* leading to the tank 6'*a* and provided with the valve 12'*a*, and into a feed conduit 11'*b* leading to the tank 6'*b* and provided with the valve 12'*b*. The feed pump 11' operates continuously, but the feeding of the tanks 6'*a* and 6'*b*, which takes place intermittently, is controlled by the valves 12'*a* and 12'*b*, which are motorized valves controlled by the regulators 14'*a* and 14'*b*, respectively, connected with the water level detectors 15'*a* and 15'*b***, respectively, so that one of these valves opens in case of want of water in the tank which, at the instant considered, is feeding the boiler.

Direct readmission of the condensates into the vapor generating boiler 1' is controlled by the motorized valve 13', itself controlled by the regulator 16' connected with the member 17' for detecting the water level in the boiler.

Whereas in the plant of FIG. 14 the condensate collecting tank 6 can permanently receive condensates through the condensate return line, the filling of each tank such as **6'*a* or 6'*b* lasts only part of its operating time, the operating cycle of each of these tanks comprising a filling stage followed by an emptying stage or a boiler water-feeding stage, the operating cycles of the two tanks being so shifted with respect to one another that when one of them is being filled the other is being emptied and vice versa. To this end, the three-way valves 77*a* and 77*b* and the two-way valves 79*a* and 79*b*, as well as the two-way valves 80*a* and 80*b* mounted on the condensate outlet conduits 7'*a* and 7'*b*, respectively, are motorized valves controlled by the control reversing relay 81 and the regulators 82*a* and 82*b*, the first of which is connected to a member 83*a* for detecting the maximum water-level and to a member 84*a* for detecting the minimum water-level in the tank 6'*a*, whereas the second is connected to a member 83*b* for detecting the maximum water-level and to a member 84*b* for detecting the minimum-water level in the tank 6'*b*. The reversing of the control reversing relay 81 takes place when the tank 6'*a* or 6'*b*** being filled becomes full.

The tanks **6'*a* and 6'*b* and their accessories operate as two admission lock means, respectively, one of which is being filled while the other is being emptied and vice versa. During the stage of filling of the tank of one of the said lock means, the inlet conduit 78*a* or 78*b*, respectively, for the condensates at the pressure $P_2$ serves to admit the condensates into the tank considered; thus, if the tank 6'*a* is the one in the filling position, the valve 79*a* is open and the valve 80*a* is closed, whereas the injection of vapor at the pressure $P_1$ into the tank 6'*a* from the line 76 is prevented by the three-way valve 77*a*; during the stage of emptying of the same tank 6'*a*, the valve 79*a* is closed and the valve 80*a* is open, whereas the three-way valve 77*a* is in a position allowing vapor at pressure $P_1$ to be supplied to the tank 6'*a* through the vapor injection line 76 and the vapor injection conduit 76*a*. Each of the tanks 6'*a* and 6'*b* is situated at a higher geographical level than that of the boiler 1'**, so that this difference in geographical level is sufficient, during the emptying stage, to force the water under pressure $P_1$ present in the tank being emptied into the line 7' for the readmission of the condensates, also at the pressure $P_1$. It will be noted that the pressure in each tank such as 6'a and 6'b is alternately at the value $P_1$ or $P_2$, one of the said tanks being at the pressure $P_1$ while the other is at the pressure $P_2$ and vice versa. Such a plant allows all the pumps for direct readmission of the condensates into the boiler to be dispensed with. In this form of embodiment, however, the need for the feed pump 11', the operation of which may be either continuous, as in the example represented, or intermittent, is due to the selected method of make-up water admission.

In the form of embodiment of FIG. 16, the same devices as in FIG. 15 are seen, the corresponding devices being denoted by the same reference numerals accompanied by the sign "second" instead of the sign "prime".

In addition, the feed pump is eliminated and replaced by admission lock means denoted generally by the reference numeral 85. These admission lock means are essentially constituted by a tank 86 supplied with make-up water through a make-up water admission line 87, the emptying of this tank taking place through a make-up water feed line 10" leading to the tanks 6'a and 6'b and provided with a two-way valve 89. The tank 86 is also connected with the line 2" for the supply of vapor at the pressure $P_1$ through the line 90b connected with the three-way valve 91 and with which is also connected the piping 92 connected upstream of the two-way valve 88. The valves 88, 89 and 91 are motorized valves controlled by the regulator 93 connected with a member 94 for detecting the maximum water level in the tank 86 and with a member 95 for detecting the minimum water level in the same tank.

The operating cycle of the admission lock means 85 comprises a stage of filling of the tank 96, at the pressure $P_0$ prevailing in the feed tank 9", through the make-up water admission line 87, the valve 88 being open and the valve 89 being closed, while the three-way valve 91 allows the piping 92 to communicate with the down-stream portion 90a of the condensate supply conduit 90. In the stage of emptying of the tank 86, the pressure in the latter is brought to the value $P_1$ higher than the pressure $P_0$. After closing the valve 88, opening the valve 89 and switching the valve 91 to allow the down-stream portion 90a of the condensate supply conduit 90 to communicate with its upstream portion 90b. On the other hand, the tank 86 is situated at a higher geographical level than the tanks 6"a and 6"b, thus permitting, during this emptying stage, the flow of liquid from the tank 86, at the pressure $P_1$, into the line 10" for feeding the tanks 6"a and 6"b with make-up water, which line 10" also is at the pressure $P_1$. It will be noted that check valves 96a and 96b, respectively, are mounted on the make-up water feed conduit 11'a and 11'b, respectively, upstream of the valves 12"a and 12"b, respectively, provided on those conduits.

As in the case of FIG. 15, the tank 6'a or 6'b which is fed with make-up water is the one which, at the instant considered, is feeding the boiler.

It will be observed that the plant of FIG. 16 eliminates the need for any mechanical or power pump owing to a systematic use of the motive force of vapor, both of the vapor distributing circuit and the circuit for the return of the condensates to the boiler, and to a judicious predetermination of the respective levels of the make-up water admission lock means and the condensate collecting tanks, between low point of the plant represented by the boiler and the high point represented by the feed tank.

Of course the present invention is by no means limited to the forms of embodiment described and illustrated which have been given by way of example only. In particular, it comprises all technical means equivalent to the means described, as well as their combinations, should the latter be carried out according to its gist and used within the scope of the following claims.

What is claimed is:

1. In a system, having at least one vapor generating boiler, one vapor utilizing condenser for production, distribution and utilization of condensable vapor, in a closed circuit wherein the pressure and temperature are substantially constant everywhere and identically the same at all points except for the pressure losses, with recovery of at least part of the condensates discharged by guided, preferably substantially dry and at least for the most part thereof generally gravitational return-flow in at least one closed container forming a main buffer-tank located at a general low point a method in particular for intermittent forced delivery of said condensates, for any selected one of the following purposes: direct reintroduction into said vapor-generating boiler, delivery into a higher-pressure system, passing of a geometrical rise such as a pitch-retaining arrangement by the discharge flow of condensates, the said method consisting in awaiting the obtention of a predetermined maximum level of filling of the said container with liquid; in isolating from the outside the upper space of the said container containing the gaseous phase by either one of the following procedures: cutting off any, at least unidirectional, fluid communication with at least the up-stream portion of the said system, stopping the up-stream inflow and preventing any return of the down-stream current of condensates into the said container; and in applying, at the free surface of the contained liquid, a sufficient additional vapor pressure to allow the total available gas pressure to be substantially equivalent to the sum of the necessary net geometrical height of delivery and the down-stream flow pressure losses to be overcome.

2. A method according to claim 1, comprising providing a controlled cyclic operation with periodical repetition and automatic control interlocked in follow-up relationship with the instant amount of condensates in the afore-mentioned container.

3. A method according to claim 1, comprising providing a collection and temporary accumulation of the condensates in at least one auxiliary buffer-tank up-stream of the said main buffer-tank during the forced delivery of the condensates from the latter.

4. A method according to claim 3, comprising providing an automatic discharge of vapor pressure from the said main buffer-tank at the end of the delivery cycle whereas the said discharge is continued until the said vapor pressure in the said main buffer-tank becomes substantially equal to the pressure of the condensates up-stream of the said main buffer-tank.

5. A method according to claim 4, wherein the said equalization of the pressures is obtained by providing the temporary controlled direct communication between either one of the following pairs of spaces: the respective upper spaces of gaseous phase confinement of the said main and auxiliary buffer tanks, respectively; the upper space of the said main buffer-tank and either one of the up-stream inflow of condensates and of the live vapor supply flow.

6. A method according to claim 1, comprising providing a safety discharge of the excess condensates present in the said main buffer-tank, into either one of a feed tank and of a lower pressure system and automatically controlled in interlocked follow-up relationship with the admissible maximum liquid level in the said main buffer-tank, in particular in the case of at most reduced needs of the aforesaid boiler in liquid to be vaporized, said method further providing a safety discharge of vapor in case of over-pressure in the said main buffer-tank, said latter discharge being automatically controlled in interlocked follow-up relationship with the admissible maximum pressure, the said excess condensates being discharged into either one of the excess condensate discharge line and of the up-stream inflow of condensates.

7. A method according to claim 1, usable in the case of at least two pumping sub-stations mounted in parallel, and consisting in providing an automatic time-lag simultaneously interlocked in follow-up relationship with the instant amounts of condensates present in the said main buffer-tanks, respectively, of the said pumping sub-stations in order to throw out of step their respective operations for the purpose of a substantially continuous replenishment of the said boiler with liquid to be vaporized, by separately operatng one of the sub-stations while the other is being filled with condensates.

8. A method according to claim 1, consisting in heating at least part of the liquid phase present in the aforesaid container by means of an input of external heat in order to respectively raise its temperature and vaporize part of the said liquid in order to raise the pressure, thus creating a flow-boosting thermodynamic pumping effect producing the circulation.

9. A method according to claim 8, consisting in providing an earlier heating beginning as soon as the condensates in the said container reach a given intermediate filling level lower than the said maximum level.

10. A method according to claim 8, consisting in providing a physical separation of the volume of condensates to be vaporized from the volume of condensates to be delivered and by the exclusive heating of the said volume of condensates to be vaporized, said method further comprising on the one hand either one of the following steps: isolating and heating said volume within the said container itself, conveying said volume into and heating same in an external adjunct container, with direct supply of produced vapor above the level of the liquid condensates to be delivered, and on the other hand the keeping of a minimum amount of condensates to be heated.

11. A method according to claim 10, consisting in the introduction, into the upper space of the said main buffer-tank, of an external input of live vapor under a higher pressure.

12. A method according to claim 11, for delivering the condensates from the said main buffer-tank to a place where the pressure is higher than that of the said live vapor, consisting in providing a combination of the introduction of the said live vapor into the said main buffer-tank and of the said vaporizing heating of at least part of the said condensates, in such a manner that the total vapor pressure thus produced in the said main buffer-tank be at least equal to the necessary delivery pressure.

13. A device in a system having at least one vapor generating boiler, one vapor utilizing condenser for production, distribution and utilization of condensable vapor in a closec circuit wherein the pressure and temperature are substantially constant everywhere and identically the same at all points except for the pressure losses, with recovery of at least part of the condensates discharged by guided, preferably substantially dry and at least for the most part thereof generally gravitational return flow in at least one closed container forming a main buffer-tank provided with at least one level controller having at least two mutually opposite working limit positions, viz. a maximum limit position and a minimum limit position, and mounted in an inclined conduit for the descending return of the condensates, ending into the aforesaid boiler, said main buffer-tank being placed at either one of a general low point to form a pumping substation for reintroduction into the boiler and of, a local low point at a pitch-retaining pipe rise to form a lift pumping sub-station for the passing of a geometrical rise, the respectively up-stream and down-stream portions of the said conduit being connected to the respectively upper and lower portions of the said main buffer-tank, with a check valve intercalated in the said down-stream conduit portion, said device further comprising means for producing vapor through either one of additional introduction and of local production of vapor in the upper space of the said main buffer-tank, the said means comprising a switching member connected by a remote-control transmission to the monitoring member of the said level controller, whereas, a check valve is mounted in series in the said up-stream conduit portion.

14. A device according to claim 13, including an isolating valve mounted in the aforesaid up-stream conduit portion, wherein the said valve is connected in series with the said corresponding check valve, up-stream of the latter, and is motor-actuated, its servo-motor being connected by a remote-control transmission to the monitoring member of the said level controller.

15. A device according to claim 13, wherein the said main buffer-tank has its upper portion connected by at least one vapor discharge conduit to the said up-stream portion of the condensate return conduit before the said check valve through the medium of a motor-actuated stop-valve whose servo-motor is connected by a remote-control transmission to the monitoring member of the said level controller.

16. A device according to claim 15, in an aforesaid, two-pipe system of vapor production and distribution, including at least two systems of lines for, respectively, the supply of live vapor and the discharge of condensates, with at least one pipe-rise arrangement in the said condensate return conduit, provided with a said main buffer-tank and at least one vapor-phase direct-connection conduit between the said two systems of lines, interconnecting the upper point of the descending branch of the said pipe-rise arrangement to a live vapor supply conduit, wherein the said vapor discharge conduit is connected to the said direct connection conduit.

17. A device according to claim 15, in an aforesaid, one-pipe system of vapor production and distribution, including at least one single live vapor supply and condensate return conduit with at least one pipe-rise provided with a said main buffer-tank and an upper vapor-phase by-pass loop bypassing the said pipe-rise arrangement and connecting the upper point of the descending branch of the latter to a point located down-stream of the said pipe-rise arrangement, wherein the said vapor discharge conduit is connected to the said loop.

18. A device according to claim 15, comprising at least one auxiliary buffer-tank intercalated in series in the up-stream portion of the said condensate return conduit before the said check valve and after an additional up-stream check valve, whereas the said vapor discharge conduit opens into the upper portion of the said auxiliary buffer-tank, the capacity of the latter being substantially equal to the volume of condensates defined between the limit level positions, namely the maximum limit level position and the minimum limit level position, of the detecting member of the said level controller in the said main buffer-tank, which respectively switch on and switch off the said heating means, therefore equal to the volume variation between two successive fillings or emptyings.

19. A device according to claim 13, in an aforesaid system of vapor production and distribution, including at least two pumping sub-stations for reintroduction of condensates, mounted in parallel, wherein the monitoring member of the said level controller of each main buffer-tank is connected by an individual remote-control transmission to a common regulator and time-lag member.

20. A device according to claim 13, in an aforesaid system of vapor production and distribution, each said main buffer-tank of which is provided with an upper-level controller and has its lower portion connected to either one of a feed tank and of a lower-pressure system by at least one condensate discharge conduit containing a check valve and a motor-actuated stop-valve whose servo-motor is connected by a remote-control transmission to the monitoring member of the said upper-level controller, wherein the upper portion of the said main buffer-tank is connected to either one of the said condensate discharge conduit and of the up-stream portion of the said condensate return conduit by a safety relief conduit containing a safety valve.

21. A device according to claim 13, comprising heating means such as a heating resistor in heat exchange and transmission connection with at least part of the lower volume of condensates contained in the said main buffer-tank.

22. A device according to claim 21, including a said main buffer-tank provided with an additional intermediate level controller, wherein the respective monitoring members of the said intermediate level controller and of said maximum and minimum level controller are connected to a member for the switching of the said heating means through the medium of a common pilot relay.

23. A device according to claim 21 wherein the said main buffer-tank comprises a substantially vertical, partial internal partition wall extending upwardly from the lower bottom of the said main buffer-tank up to a predetermined height corresponding to a maximum level, thus subdividing the said main buffer-tank into two unequal sections communicating with one another in the upper portion, i.e. in the vapor-phase space, of the said main buffer-tank, the said partition wall being provided with at least one interconnecting through-orifice located at the said intermediate level, whereas the said heating means is placed in the smaller section towards the base of the latter, the useful capacity of which corresponds to the necessary minimum amount of liquid to be vaporized.

24. A device according to claim 21, wherein the said heating means is placed in a closed enclosure, the capacity of which is substantially equal to the volume of liquid to be vaporized in order to form a vapor generator and the respectively lower and upper portions of which communicate respectively with the lower and upper portions of the said main buffer-tank, at least an upper portion of the said enclosure being located substantially at most at the level of the said lower portion of the said main buffer-tank.

25. A device according to claim 24, wherein the said heating means is located outside the said buffer-tank and the lower and upper portions of its said enclosure are connected by respective conduits to the corresponding portions of the said main buffer-tank in the base of which the said conduit, proceeding from the lower portion of the said enclosure, penetrates and opens substantially vertically up to a height corresponding to the said intermediate level.

26. A device according to claim 24, including heating means located outside the said main buffer-tank and comprising an elongated hollow body, for example cylindrically tubular in shape, forming the aforesaid enclosure and placed either horizontally with at least one lower communication orifice opening towards its free end and an open vertical communication conduit extending from its upper portion into the upper space of the said main buffer-tank or vertically with communication orifices opening respectively towards its base and towards its top.

27. A device according to claim 21, wherein at least one live vapor supply conduit opens into the upper portion of the said main buffer-tank and is provided with a motor-actuated isolating valve, the servo-motor of which is connected by a remote-control transmission to the monitoring member of the aforesaid level controller of the said main buffer-tank.

28. A device according to claim 27, provided with a said main buffer-tank connected at its lower portion by means of a delivery conduit to either one of an aforesaid boiler and of a system of lines wherein the pressure is higher than that of the said live vapor, said main buffer-tank being provided with both the aforesaid vaporizing heating means and live vapor supply conduit connecting the upper portion of the said main buffer-tank to a live vapor supply source to thus constitute a combined pumping sub-station.

29. In a method for feeding vaporizable liquid to a system for producing, distributing and utilizing condensable vapor wherein the system includes at least one boiler, a vapor distributing system having a point of vapor supply and at least one point of mechanical condensate discharge a condensate return system including at least one buffer-tank for holding and temporarily storing all the condensates for return to the said boiler and a source of vaporizable make-up liquid for supplying said system, the method including the steps of producing vapor in the boiler in a closed loop circulation at a substantially constant temperature and pressure except for pressure losses, on the one hand, in the vapor distributing system between the vapor supply point and at least one of the mechanical condensate discharge points, and on the other hand, in the condensate return system between the point of discharge and at least one of the buffer tanks, with the pressure in the condensate return system no higher than the pressure in the vapor distributing system and effecting return of the condensates to the boiler under at least one of gravitational force and the motive action of the vapor within said system, and the impovement comprising the step of directing all the vaporizable make-up liquid to the collecting tank to supply the boiler with its total vaporizable liquid requirement.

30. A method according to claim 29 comprising continuously drawing vapor at maximum pressure from the vapor distributing system and supplying said vapor to the said collecting tank permanently to maintain therein a higher pressure than the pressure on the saturation vapor tension curve which corresponds to the temperature of the condensates.

31. A method according to claim 29, comprising automatically controlling the intake of vaporizable make-up liquid into the said system so that the water level in the boiler governs only the direct reintroduction of the said liquid into the boiler from the collecting tank.

32. A method according to claim 29, comprising automatically controlling the intake of vaporizable liquid into the boile- from the said collecting tank, said intake depending only on the water level in the boiler.

33. A method according to claim 29, comprising placing a collecting tank above the vaporizable liquid level in the boiler to direct the intake of vaporizable liquid to the boiler without requiring the use of any mechanical or power pump, directing the condensates at the pressure in the condensate return system into said collecting tank during a stage of filling said tank and allowing the said collecting tank to form distributing lock means, and to communicate with the vapor distributing system during a stage of emptying of the said collecting tank and of return of the condensates to the boiler.

34. A method according to claim 33, comprising mounting a pair of collecting tanks in parallel and in a similar manner in the downstream portion of the condensate return system and connecting said collecting tanks in a similar manner with the vapor intake at the pressure in the vapor distributing system, emptying one of the collecting tanks while filling the other tank and reversing the order when the tank being filled is full.

35. A method according to claim 29, comprising placing an auxiliary tank above the vaporizable liquid level in the condensate collecting tank to readmit the vaporizable make-up liquid into the collecting tank without requiring pumping, feeding, the auxiliary tank with make-up liquid while filling the auxiliary tank, the make-up liquid being at a lower pressure than the pressure prevailing in the condensate return system, directing the make-up fluid from the auxiliary tank to at least one collecting tank while emtpying of the auxiliary tank by allowing the auxiliary tank to communicate with the vapor distributing system.

36. A method according to claim 35 comprising automatically controlling the intake of vaporizable liquid into the said auxiliary tank in dependence upon the quantity of liquid in the said auxiliary tank.

37. A method according to claim 34, comprising directing the intake of vaporizable make-up liquid into the system only to that one of the two collecting tanks that is in the emptying stage.

38. A method according to claim 30 wherein the pressure of said drawn vapor is reduced in a pressure-loss device prior to feeding same to said collecting tank.

39. A method according to claim 30 wherein the vapor from the vapor distribution system is fed to a pressure reducing device to reduce the pressure prior to being supplied to the collecting tank.

* * * * *